US008077192B2

(12) United States Patent
Saquib et al.

(10) Patent No.: US 8,077,192 B2
(45) Date of Patent: Dec. 13, 2011

(54) PLATEN TEMPERATURE MODEL

(75) Inventors: Suhail S. Saquib, Shrewsbury, MA (US); Brian Busch, Sudbury, MA (US)

(73) Assignee: ZINK Imaging, Inc., Bedford, MA (US)

( * ) Notice: Subject to any disclaimer, the term of this patent is extended or adjusted under 35 U.S.C. 154(b) by 906 days.

(21) Appl. No.: 11/969,971

(22) Filed: Jan. 7, 2008

(65) Prior Publication Data

US 2009/0175310 A1 Jul. 9, 2009

(51) Int. Cl.
*B41J 2/00* (2006.01)

(52) U.S. Cl. ..... 347/194

(58) Field of Classification Search ..... 347/188, 347/194

See application file for complete search history.

(56) References Cited

U.S. PATENT DOCUMENTS

| | | | | |
|---|---|---|---|---|
| 4,467,335 | A | 8/1984 | Schmidt et al. | |
| 5,051,756 | A | 9/1991 | Nomura et al. | |
| 5,220,350 | A * | 6/1993 | Fujii | 347/194 |
| 5,310,989 | A | 5/1994 | Russell et al. | |
| 5,553,951 | A | 9/1996 | Simpson et al. | |
| 5,869,010 | A | 2/1999 | Langer | |
| 6,134,808 | A | 10/2000 | Yapel et al. | |
| 6,186,207 | B1 | 2/2001 | Berghauser et al. | |
| 6,312,879 | B1 | 11/2001 | Slusarek et al. | |
| 6,413,708 | B1 | 7/2002 | Slusarek et al. | |
| 6,426,179 | B1 | 7/2002 | Slusarek et al. | |
| 6,431,771 | B2 | 8/2002 | Nagai et al. | |
| 6,440,618 | B1 | 8/2002 | Slusarek et al. | |
| 6,506,528 | B1 | 1/2003 | Owczarczyk et al. | |
| 6,506,546 | B1 | 1/2003 | Owozarczyk et al. | |
| 6,509,393 | B2 | 1/2003 | Malhotra | |
| 6,534,226 | B1 | 3/2003 | Owczarczyk et al. | |
| 6,537,712 | B1 | 3/2003 | Slusarek et al. | |
| 6,597,385 | B2 * | 7/2003 | Verdyck | 347/171 |
| 6,756,192 | B1 | 6/2004 | Slusarek et al. | |
| 6,759,187 | B1 | 7/2004 | Slusarek et al. | |
| 6,790,569 | B2 | 9/2004 | Yang et al. | |
| 7,112,398 | B2 | 9/2006 | Slusarek et al. | |
| 7,295,224 | B2 * | 11/2007 | Busch et al. | 347/188 |
| 2002/0018944 | A1 | 2/2002 | Irving et al. | |
| 2002/0018967 | A1 | 2/2002 | Irving et al. | |
| 2002/0025498 | A1 | 2/2002 | Yang et al. | |
| 2003/0058326 | A1 * | 3/2003 | Araki et al. | 347/217 |
| 2003/0129552 | A1 | 7/2003 | Slusarek et al. | |
| 2004/0142255 | A1 | 7/2004 | Slusarek et al. | |
| 2004/0165054 | A1 | 8/2004 | Saquib et al. | |
| 2008/0136891 | A1 * | 6/2008 | Takano et al. | 347/194 |

FOREIGN PATENT DOCUMENTS

| | | | |
|---|---|---|---|
| JP | 2004-142212 | * | 5/2004 |
| JP | 2005246694 | * | 9/2005 |

OTHER PUBLICATIONS

S.S. Saquib and W.T. Vetterling, "A real-time multi-resolution algorithm for correcting distortions produced by thermal printers," in Proc. of SPIE-IS&T Electronic Imaging, pp. 269-281, (San Jose, CA), Jan. 2005.

* cited by examiner

*Primary Examiner* — Charlie Peng
(74) *Attorney, Agent, or Firm* — Robert Plotkin, P.C.

(57) ABSTRACT

The input energies provided to a print head of a thermal printer are adjusted based on the temperature of a platen in the thermal printer. The platen temperature may be measured by a sensor or predicted by a platen temperature model. Such a model may derive the predicted platen temperature from an observed temperature of a heat sink in the thermal printer. A thermal history control algorithm may use the platen temperature, whether actual or predicted, to compensate for the platen temperature by adjusting the input energies.

34 Claims, 23 Drawing Sheets

PLATEN TEMPERATURE MODEL

CROSS REFERENCE TO RELATED APPLICATIONS

This application is related to the following U.S. patents/applications, which are hereby incorporated by reference herein:

U.S. Pat. No. 6,819,347, issued on Nov. 16, 2004, entitled, "Thermal Response Correction System";

U.S. Pat. No. 7,295,224, issued on Nov. 13, 2007, entitled, "Thermal Response Correction System";

U.S. Pat. No. 7,298,387, issued on Nov. 20, 2007, entitled, "Thermal Response Correction System";

U.S. Pat. No. 7,176,953, issued on Feb. 13, 2007, entitled "Thermal Response Correction System"; and U.S. patent application Ser. No. 11/332,530, filed on Jun. 13, 2006, entitled, "Printer Thermal Response Calibration System".

BACKGROUND

Referring to FIG. 10, a block diagram is shown of a typical thermal printer 1002. The printer 1002 contains a thermal print head (TPH) 1008 having a linear array of heating elements 1010 (also referred to herein as "print head elements") that print on an output medium 1012 by, for example, transferring pigment from a donor sheet to the output medium 1012 or by initiating a color-forming reaction in the output medium 1012. The output medium 1012 is typically a porous receiver receptive to the transferred pigment, or a paper coated with the color-forming chemistry. Each of the print head elements 1010, when activated, forms color on the medium 1012 passing underneath the print head element, creating a spot having a particular optical density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of colorant to the output medium 1012 or the formation of color in the output medium 1012. The density of the output produced by the print head element in this manner is a function of the amount of energy provided to the print head element. The amount of energy provided to the print head element may be varied by, for example, varying the amount of power provided to the print head element within a particular time interval or by providing power to the print head element for a varying time interval.

The thermal printer 1002 also contains a platen 1014 which comes into contact with the output medium 1012 as it passes through the printer 1002. The platen temperature, which may change over time, therefore affects the temperature of the medium 1012 as the medium 1012 passes under the thermal print head 1008. The temperature of the output medium 1012 affects the print density. Because the temperature of the platen 1014 affects the temperature of the output medium 1012, the platen temperature therefore indirectly affects print density, thereby causing undesirable artifacts in the output.

What is needed, therefore, are techniques for eliminating or mitigating undesirable effects of platen temperature on print density.

SUMMARY

The input energies provided to a print head of a thermal printer are adjusted based on the temperature of the platen in the thermal printer. The platen temperature may be measured by a sensor or predicted by a platen temperature model. Such a model may derive the predicted platen temperature from an observed temperature of a heat sink in the thermal printer. A thermal history control algorithm may use the platen temperature, whether actual or predicted, to compensate for the platen temperature by adjusting the input energies.

Other features and advantages of various aspects and embodiments of the present invention will become apparent from the following description and from the claims.

DETAILED DESCRIPTION

There are two options for ensuring accurate control over the print densities stemming from platen temperature variations: (1) maintaining the platen 1014 at a fixed temperature; and (2) actively compensating for the temperature of the platen 1014 by modifying the energy supplied to the print head 1008. It is not easy in practice to maintain the platen 1014 at a fixed temperature because, for example, the platen 1014 may be heated and/or cooled directly by the print head 1008 through the medium 1012 during printing or by the printer frame 1018 while the printer 1002 is idling or printing. The only practical solution, therefore, is to actively compensate for changes in the platen temperature.

This requires some means to measure the platen temperature. It is undesirable, however, to directly measure the platen temperature for at least two reasons. First, the moving platen surface complicates the placement and reliability of the temperature sensor. Second, providing the thermal printer 1002 with an additional sensor has a non-trivial cost which may be prohibitive in an otherwise inexpensive consumer printer.

Some embodiments of the present invention are directed to a computational model for predicting the platen temperature based on data obtained from an existing temperature sensor 1004 attached to the heat sink 1006 of the print head 1008. This predicted platen temperature is then used in conjunction with a thermal history control (THC) algorithm to control the energy to the print head 1008.

Embodiments of the present invention are directed to a model of platen temperature as a function of a temperature within the thermal printer, such as a function of a heat sink in the thermal printer. For example, referring to FIG. 11, one embodiment of the platen temperature model 1100 is illustrated in block diagram form. Referring to FIG. 12, a flowchart is shown of a method 1200 for using the model 1100 to predict temperatures of the platen 1014 according to one embodiment of the present invention. Note that although a heat sink temperature may be described in particular embodiments herein as a temperature that may be used to predict the platen temperature, the heat sink temperature is merely one example of a temperature within the thermal printer that may be used to predict the platen temperature.

Figure 11:
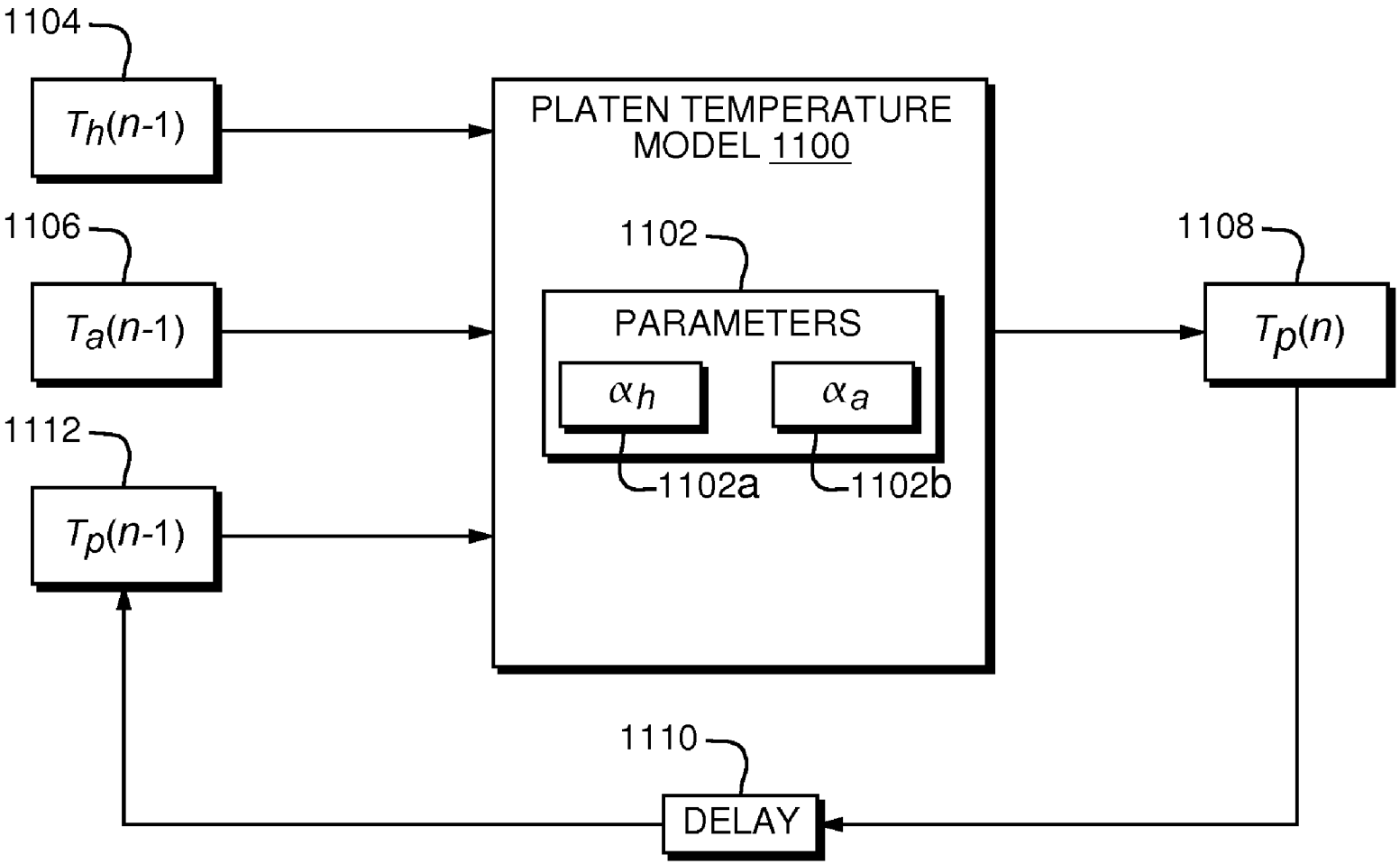
FIG. 11 is a block diagram of a platen temperature model according to one embodiment of the present invention.
Figure 12:
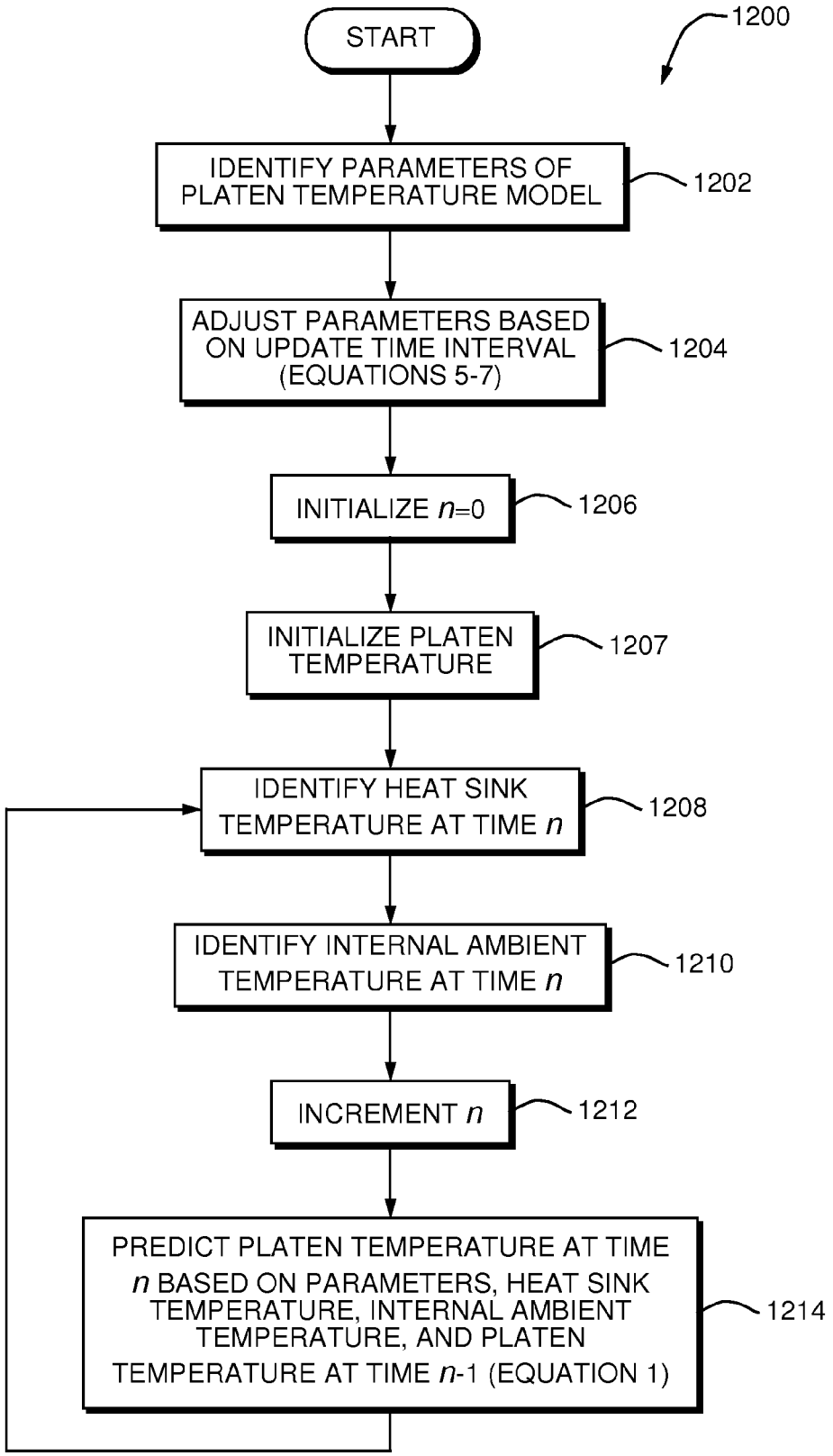
FIG. 12 is a flowchart of a method for predicting the platen temperature according to one embodiment of the present invention.

In the embodiment illustrated in FIGS. 11 and 12, the model 1100 assumes that there are two heat sources/sinks for the platen 1014, and that the primary heat flow occurs between the platen 1014 and the heat sink 1006 of the print head 1008, either directly from the print head 1008 to the platen 1014 via the output medium 1012, or indirectly to/from the frame 1018 of the printer 1002. The model 1100 further assumes that the secondary heat flow is between the platen 1014 and the ambient air 1016 inside the printer 1002. The heat flux is proportional to the temperature differential between the platen 1014 and the heat-sink 1006/internal ambient air 1016. The platen temperature $T_p$ may be updated from time instance $(n-1)\Delta t$ to $n\Delta t$ ($\Delta t$ being the update time interval) according to Equation 1.

$$\begin{aligned} T_p(n) &= T_p(n-1) + \alpha_h(T_h(n-1) - T_p(n-1)) + \\ &\quad \alpha_a(T_a(n-1) - T_p(n-1)) \\ &= \alpha_p T_p(n-1) + \alpha_h T_h(n-1) + \alpha_a T_a(n-1) \end{aligned} \qquad \text{Equation 1}$$

The quantity $\alpha_p$ in Equation 1 is defined by Equation 2.

$$\alpha_p \equiv 1 - \alpha_a - \alpha_h, \qquad \text{Equation 2}$$

The quantities $T_h$ and $T_a$ in Equation 1 are the temperatures of the heat sink 1006 and internal ambient air 1016, respectively. Therefore, and as shown in FIG. 11, the platen temperature $T_p(n)$ 1108 at time instance $n\Delta t$ is updated based on the heat sink temperature $T_h(n-1)$ 1104 at time instance $(n-1)\Delta t$ and the internal ambient air temperature $T_a(n-1)$ 1106 at time instance $(n-1)\Delta t$. In the interest of retaining generality, we have denoted the internal ambient temperature $T_a$ as a function of time. In practice, $T_a$ varies on a much longer time scale than $T_h$ and may be updated much more infrequently without a significant loss in accuracy.

Figure 13:
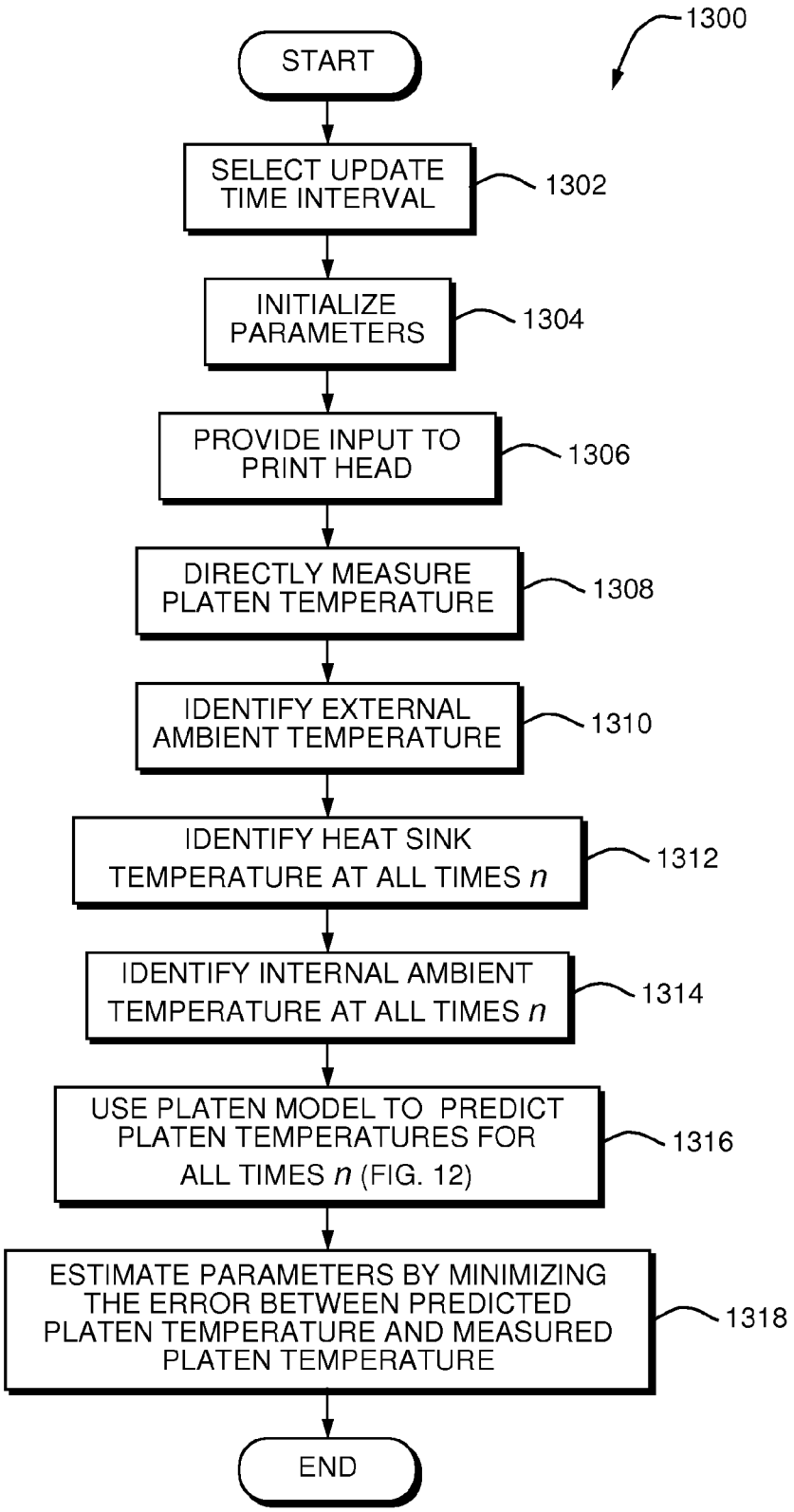
FIG. 13 is a flowchart of a method for estimating the parameters of the platen temperature model according to one embodiment of the present invention.

The platen temperature model 1100 includes parameters $\alpha_h$ 1102*a* and $\alpha_a$ 1102*b*, which control the heat flow between the platen and the heat-sink ($\alpha_h$) and the internal ambient ($\alpha_a$), respectively. Note that these parameters are functions of the update time $\Delta t$. These parameters 1102 may be estimated from direct measurement of the platen temperature under different printing conditions. The parameters 1102 may be estimated in any of a variety of ways, examples of which will be described below. In general, however, FIG. 13 shows a flowchart of a method 1300 that may be used to estimate the parameters 1102.

An update time interval $\Delta t$ is selected (step 1302). The parameters 1102 are initialized to some initial values (step 1304). Input energies are provided to the print head 1008 to cause it to produce output on the output medium 1012 (step 1306). For example, input energies representing an image to be printed may be provided to the print head 1008 over a sequence of time intervals. During the course of printing, the temperature $T_p$ of the platen 1014 is directly measured (step 1308), such as by using a temperature sensor (not shown) coupled to the platen 1014. The external ambient temperature is identified (step 1310). The heat sink temperature is identified at all time instances $n\Delta t$ (step 1312).

The temperature $T_a$ of the ambient air 1016 is identified (step 1314), such as through direct measurement or estimation via model. The platen model is used to predict the platen temperatures for all time instances $n\Delta t$ (step 1316). The parameters 1102 are estimated by minimizing the error between the measured platen temperature and the predicted platen temperature at all time instances produced by step 1214 (step 1318). Although steps 1306-1318 are illustrated as a single iteration in FIG. 13, any number of these steps may be performed repeatedly and/or in parallel in order to produce final estimates of the parameters 1102.

Figure 1:
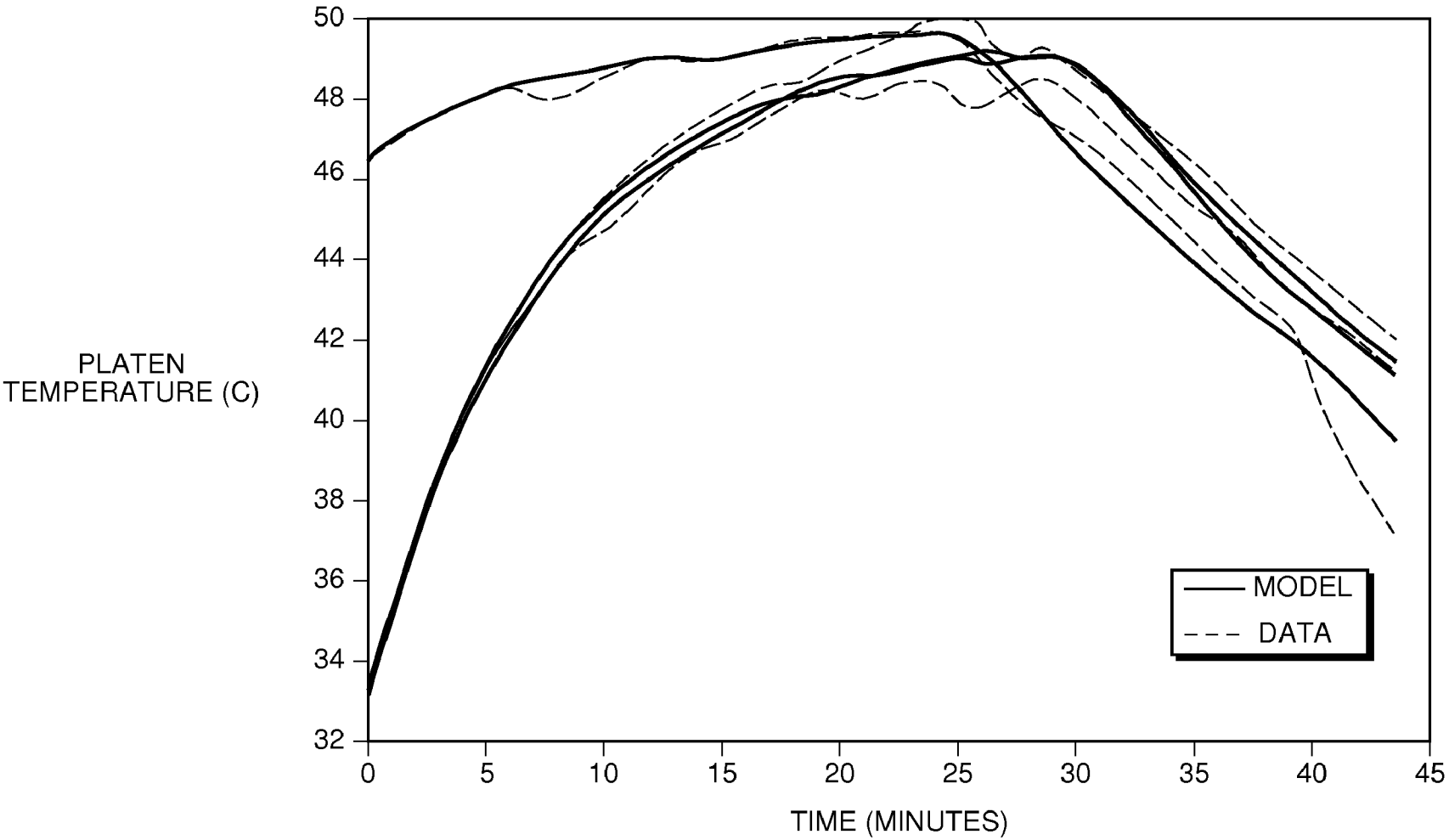
FIG. 1 is a graph illustrating fit of a platen temperature model to platen temperature measurements according to one embodiment of the present invention.

FIG. 1 shows an example where the parameters 1102 are estimated by minimizing the mean square error between the model output 1108 and the actual platen temperature measurements. More specifically, FIG. 1 shows the platen model temperature prediction 1108 along with actual measured platen temperature for three different print sequences. In two of the sequences the platen 1014 warmed up from 34C to 54C and was then allowed to cool back by idling the printer 1002. In the third sequence, the platen 1014 was already hot when printing began, which was again followed by a cool off period. The update time interval $\Delta t$ for the model in this case was 10 seconds. The internal ambient temperature was estimated to be 33.94 C, $\alpha_k$ 1102*a* was estimated to be 0.026795, and $\alpha_a$ 1102*b* was estimated to be 0.011829.

The heat-sink temperature 1106 driving the model 1100 is not shown in the plot of FIG. 1, and the internal ambient temperature 1106 is assumed to be constant. Ways in which the internal ambient temperature may be estimated if a dedicated sensor is not available for this measurement will be described below.

Figure 2A:
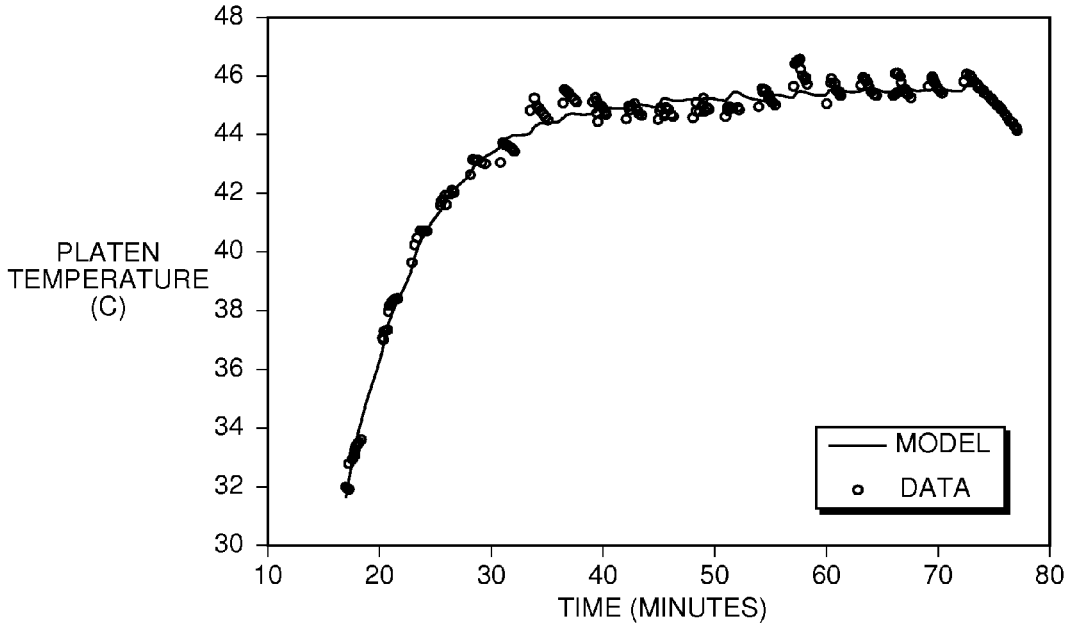
FIGS. 2A and 2B are graphs illustrating fit of the platen temperature model using data sets collected over longer periods of time according to one embodiment of the present invention.
Figure 2B:
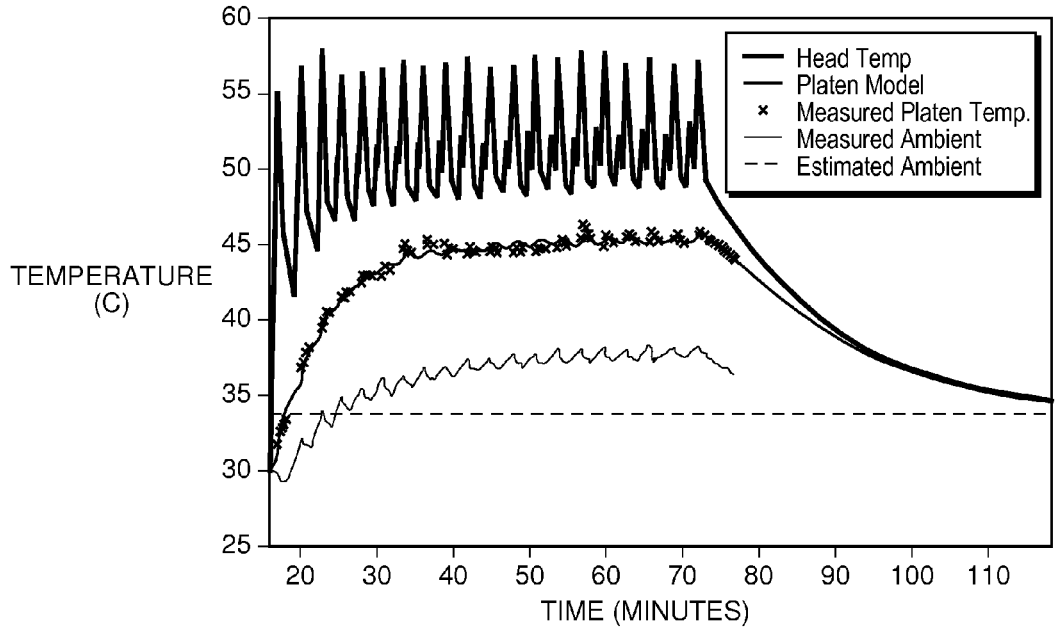

FIG. 2A shows another graph of the platen model 1100 fit to another data set collection over a longer period. Note that the data are non-uniformly sampled in time. The readings were obtained when the printer 1002 was idling between prints. FIG. 2B shows the platen temperature in the context of the measured heat-sink temperature and the internal ambient temperature. The internal ambient temperature used by the model 1100 is assumed to be constant and is estimated from the heat sink and platen data to be 33.93 C.

Note that the estimated model parameters, $\alpha_h$ 1102*a* and $\alpha_a$ 1102*b* in FIG. 2, are very similar to the case shown in FIG. 1, which speaks to the repeatability of the platen temperature.

Once the parameters 1102 have been updated, they may be used to predict the platen temperature using Equation 1, as further shown in FIG. 12. The time instance counter n is initialized to an initial value, such as zero (step 1206), and the platen temperature is initialized (step 1207). Values of the heat sink temperature and internal ambient temperature are identified at time instance nΔt (steps 1208 and 1210). Examples of techniques that may be used to identify these values will be described below.

The time instance counter n is incremented (step 1212). The platen temperature $T_p(n)$ 1108 at time instance n is updated based on the parameters 1102, the heat sink temperature $T_h(n-1)$ 1104, the internal ambient temperature $T_a(n-1)$ 1106, and the platen temperature $T_p(n-1)$ 1112 (step 1214). The method 1200 returns to step 1208 and repeats steps 1208-1214, thereby repeatedly updating the platen temperature $T_p(n)$ 1108 for each successive time interval.

Recall that the platen temperature model 1100 of Equation 1 updates the platen temperature $T_p(n)$ 1108 at an update interval Δt. It is useful to derive how the model parameters 1102 scale with respect to the update time interval. Let Δt'=kΔt be a new time update interval for the platen model. We are interested in computing $\alpha_h(\Delta t')$ and $\alpha_a(\Delta t')$ in terms of $\alpha_h(\Delta t)$ and $\alpha_a(\Delta t)$. For the sake of readability, we will sometimes drop the explicit dependence of the α's on the update time interval. In these instances, the α's are assumed to depend on Δt rather than Δt'.

Repetitive application of Equation 1 k times yields Equation 3.

$$T_p(k) = \alpha_p^k T_p(0) + \alpha_h \sum_{m=0}^{k-1} \alpha_p^m T_h(k-1-m) + \alpha_a \sum_{m=0}^{k-1} \alpha_p^m T_a(k-1-m) \quad \text{Equation 3}$$

The values $\{T_h(0), \ldots, T_h(k-1)\}$ are not available in the coarser sampling interval Δt'. The model of Equation 1, however, assumes that the update time interval is small enough that it is accurate to assume a constant heat-sink and internal ambient temperature throughout the interval. Therefore, assuming $T_h(m) \approx T_h(0)$, $T_a(m) \approx T_a(0)$, m=0, . . . , k−1, Equation 3 reduces to Equation 4.

$$T_p(k) \approx \alpha_p^k T_p(0) + \frac{1-\alpha_p^k}{1-\alpha_p}\alpha_h T_h(0) + \frac{1-\alpha_p^k}{1-\alpha_p}\alpha_a T_a(0) \quad \text{Equation 4}$$

Since Equation 4 represents the platen temperature update over time interval kΔt, the model parameters for the new update time are obtained by comparing the forms of Equation 4 and Equation 1, as shown in Equation 5-Equation 7.

$$\alpha_p(k\Delta t) = [\alpha_p(\Delta t)]^k \quad \text{Equation 5}$$

$$\alpha_h(k\Delta t) = \frac{1-\alpha_p(k\Delta t)}{1-\alpha_p(\Delta t)}\alpha_h(\Delta t) \quad \text{Equation 6}$$

$$\alpha_a(k\Delta t) = \frac{1-\alpha_p(k\Delta t)}{1-\alpha_p(\Delta t)}\alpha_a(\Delta t) \quad \text{Equation 7}$$

We verify that the property required by Equation 2 is still satisfied for these scaling formulae, as shown in Equation 8. In the case where update time interval kΔt is used, the parameters 1102*a-b* may be identified (step 1202) and then adjusted for the update time interval kΔt before performing step 1206 in FIG. 12 (step 1204).

$$\begin{aligned} 1-\alpha_h(\Delta t')-\alpha_a(\Delta t') &= 1-\frac{1-\alpha_p(\Delta t')}{1-\alpha_p(\Delta t)}\alpha_h(\Delta t) - \frac{1-\alpha_p(\Delta t')}{1-\alpha_p(\Delta t)}\alpha_a(\Delta t) \\ &= \alpha_p(\Delta t')\left(\frac{\alpha_h(\Delta t)+\alpha_a(\Delta t)}{1-\alpha_p(\Delta t)}\right) \\ &= \alpha_p(\Delta t') \end{aligned} \quad \text{Equation 8}$$

The platen temperature model 1100 given by Equation 1 requires the platen temperature at the previous time instance 1112 to obtain the current prediction 1108. This poses a problem at start-up since we do not have an initial estimate (i.e., at n=0) of the platen temperature. The only reading available at start-up is that of the heat-sink 1006. One option is to just initialize the platen temperature to the heat-sink temperature on which we have a thermistor 1004. This strategy is good if the printer 1002 has been shut down for a long time and the internal structure of the printer 1002 is in thermal equilibrium. However, it is not very good when the printer 1002 is started in a non-equilibrium state, such as after a printer crash during active printing.

Figure 3:
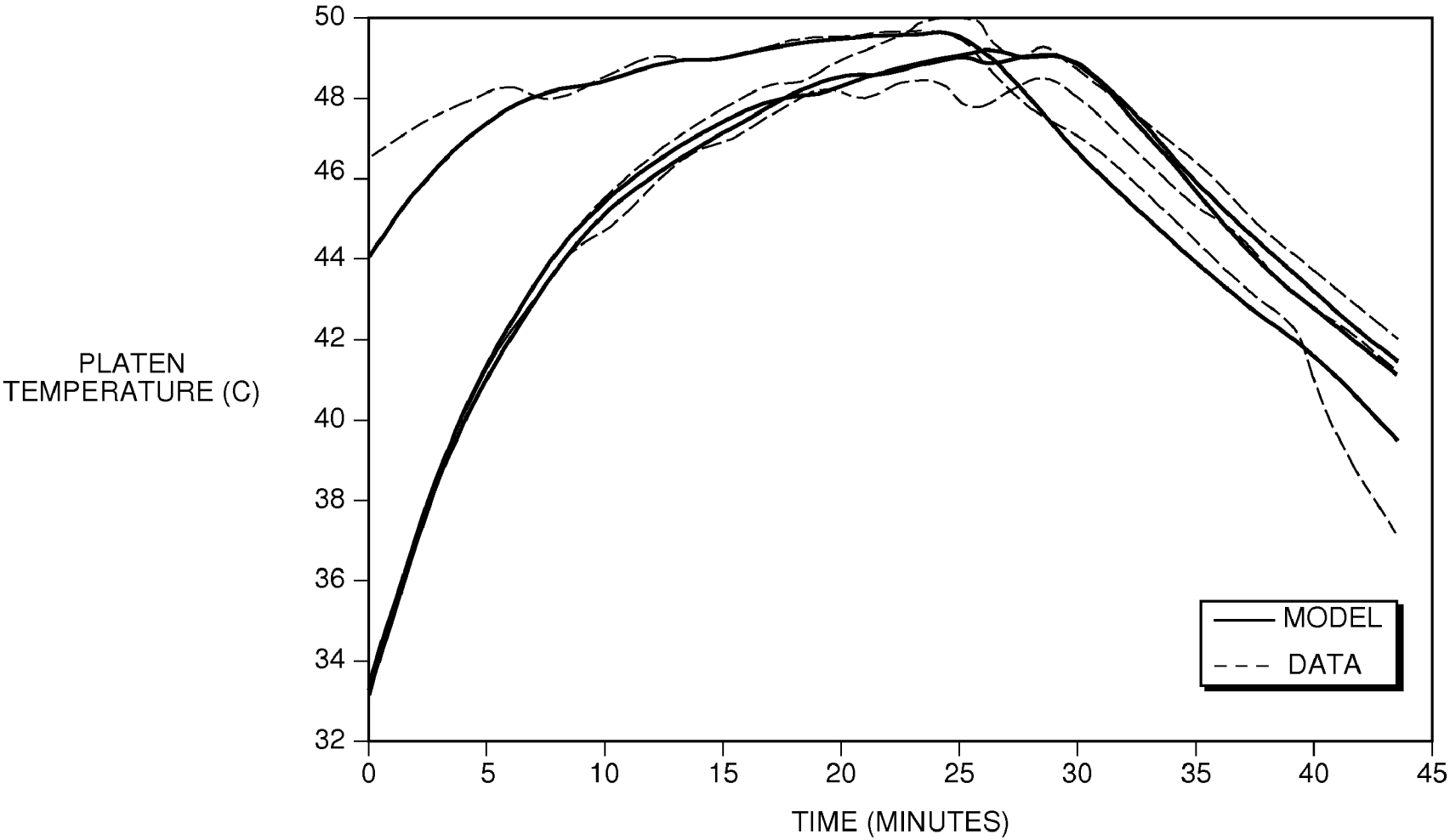
FIG. 3 is a graph illustrating results of a simulation in which the platen temperature model is incorrectly initialized.

FIG. 3 shows a simulation for the case shown in FIG. 1 where the platen model 1100 is incorrectly initialized. As shown in FIG. 3, it takes about 10 to 15 minutes for the error in the platen temperature to be erased and about 5 minutes to get the error within 1 C. Since this a long time, a better algorithm is required to initialize the platen temperature.

Let the time indices −k and 0 denote shut-down and wake-up time instances respectively. For the following treatment of platen temperature initialization, we will assume that $T_a$ is approximately constant whenever the time index is omitted. If the value of $T_a$ is not constant between the shut-down and wake-up time, an average value may be used. Examples of two initialization options will now be described: steady state initialization and dynamic state initialization.

If the head heat-sink 1006 is in steady state (determined from rate of change of its temperature), then the platen temperature at start-up is given by Equation 9.

$$T_p(0) = \frac{\alpha_h T_h(0) + \alpha_a T_a(0)}{\alpha_h + \alpha_a} \quad \text{Equation 9}$$

Figure 14A:
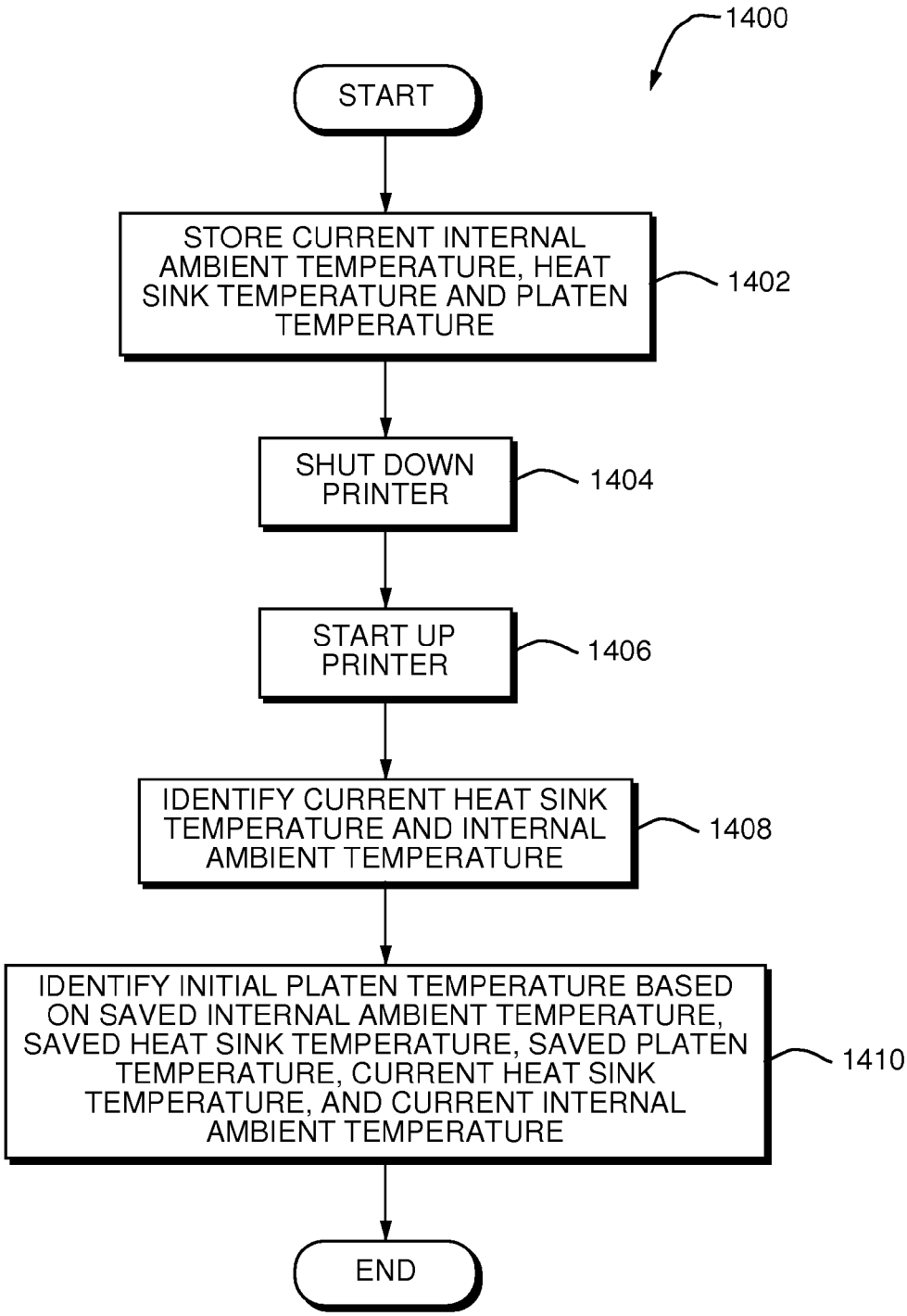
FIGS. 14A-14C are flowcharts of methods for initializing the platen temperature in the platen temperature model according to one embodiment of the present invention.

Referring to FIG. 14A, a flowchart is shown of one method for performing dynamic state initialization. If the internal ambient temperature, heat-sink temperature, and model platen temperature are stored to flash memory before shut-down (steps 1402 and 1404), these values may be used to compute a more accurate prediction of current platen temperature 1108 when the head 1008 is in a dynamic state, as given by Equation 10. More specifically, once the printer 1008 has been started up (step 1406), the current heat sink and internal ambient temperature may be identified (step 1408). The saved internal ambient temperature, saved heat sink temperature ($T_h(-k)$), saved platen temperature ($T_h(-k)$), current heat sink temperature ($T_h(0)$), and current internal ambient temperature ($T_a(0)$) may be used to identify the initial platen temperature according to Equation 10 (step 1410). Note that the saved heat sink temperature and saved platen temperature may be identified simply by reading those saved temperatures, without using the value of k.

$$T_p(0) = T_a(0) + (T_p(-k) - T_a(0))\frac{T_h(0) - T_a(0)}{T_h(-k) - T_a(-k)} \quad \text{Equation 10}$$

Figure 4:
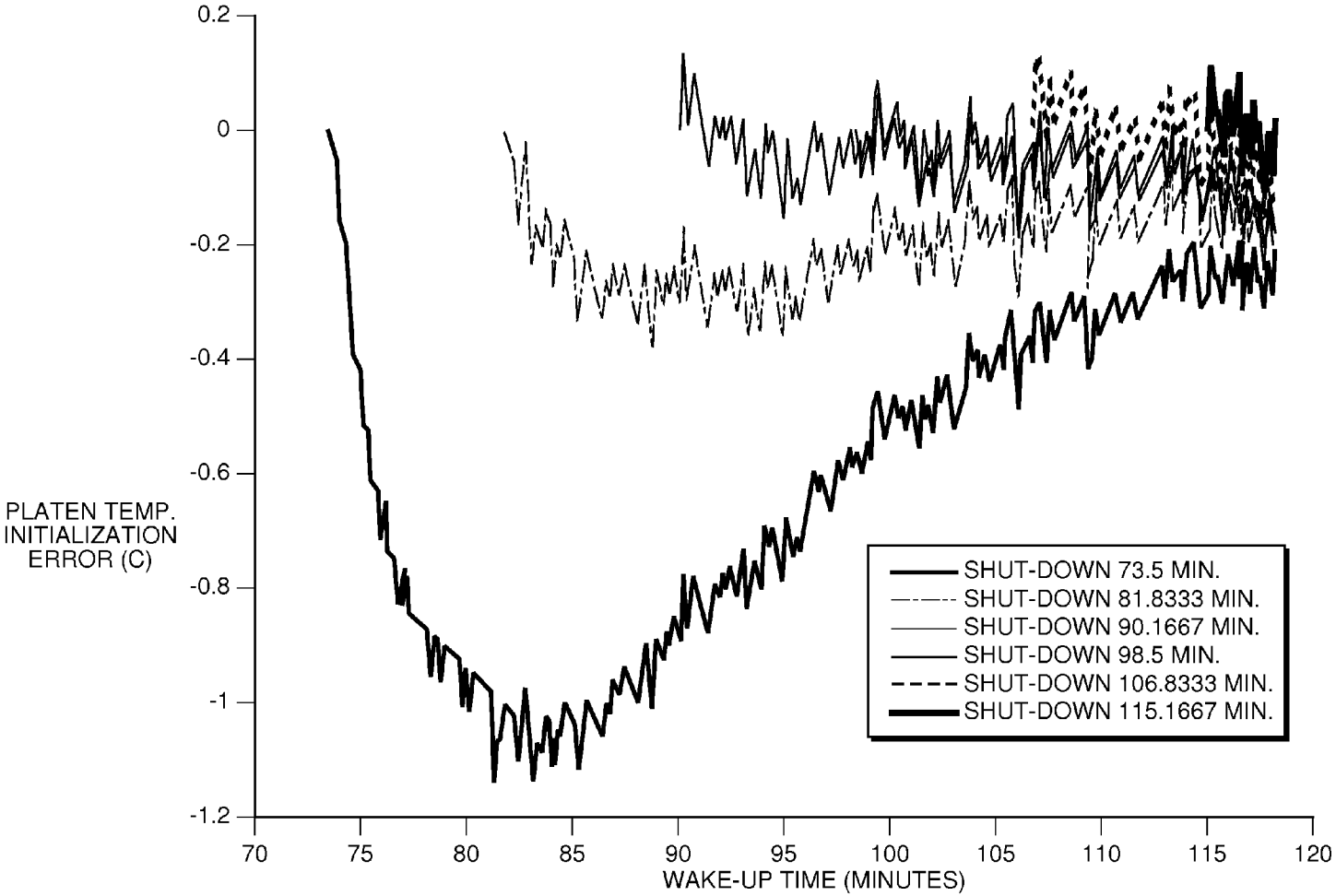
FIG. 4 is a graph of the initialization error in the platen temperature model for the case shown in FIG. 2 according to one embodiment of the present invention.

This model assumes that the decay time constant of the print head 1008 is approximately equal to the decay time constant of the platen 1014. FIG. 4 shows how good this assumption is for the data presented in FIG. 2 by illustrating the initialization error in the platen temperature model 1100 using Equation 10 for the case shown in FIG. 2. The different plots show the error for a variety of shut-down times when the printer 1002 was idling. The error is plotted as a function of wake-up time.

The maximum error in this case is approximately 1 C. The errors are larger when then the printer 1002 is shut down very soon after printing and then restarted within 10 minutes. The initialization error improves as more time elapses between shut-down and wake-up or the printer 1002 is shut down after at least 10 minutes of idling.

Figure 14B:
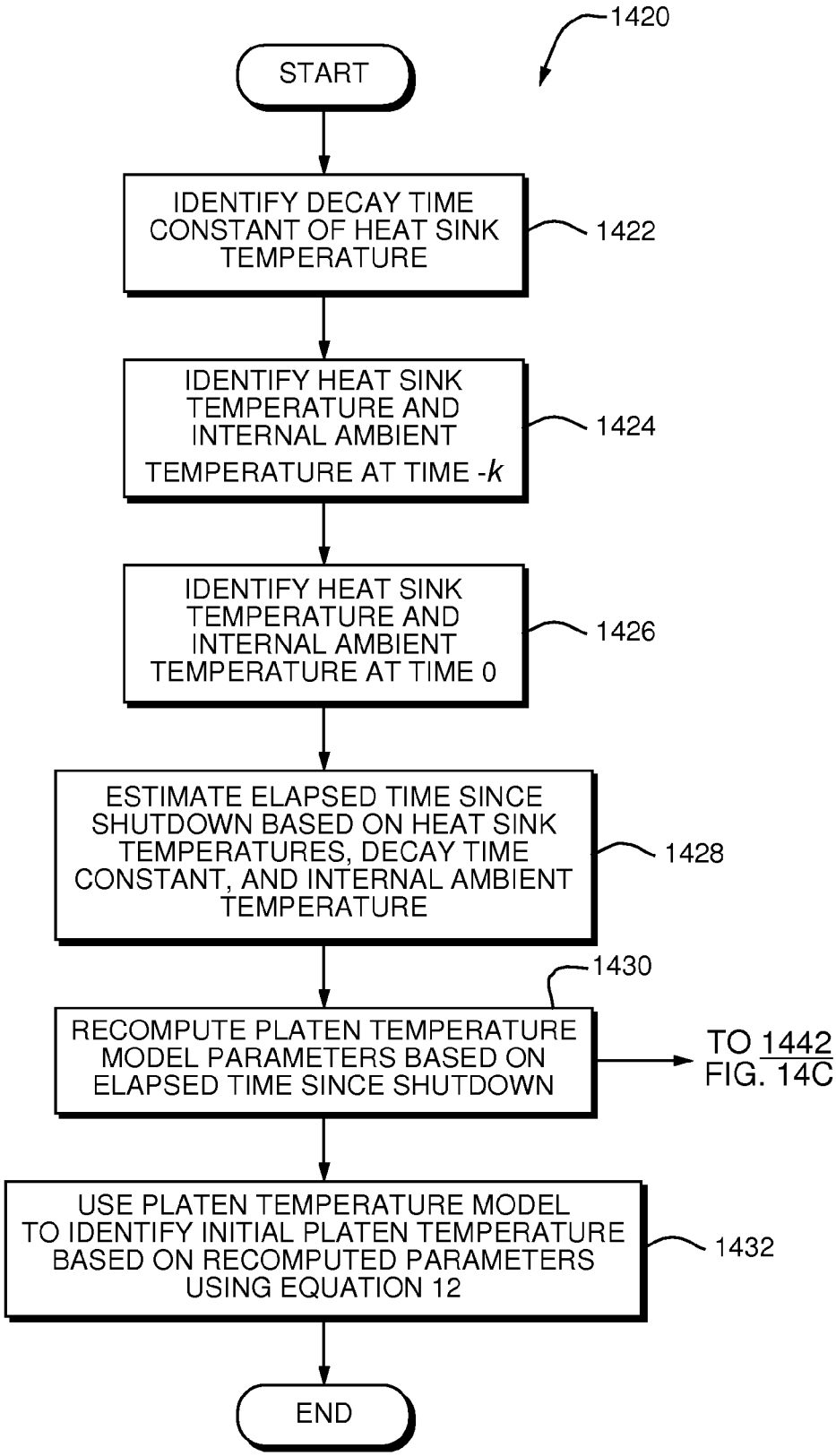

An alternative initialization model estimates the elapsed time between shut-down and wake-up and then uses the platen model 1100 given by Equation 1 to update the platen temperature at the present time instance. This model assumes that the heat-sink temperature decays with a single time constant for the purposes of computing the elapsed time. Referring to FIG. 14B, a flowchart is shown of a method 1400 for identifying the initial platen temperature using this alternative initialization model.

Let $\tau_h$ denote the decay time constant of the heat-sink 1006 when the printer 1002 is idling (step 1422). For the data set shown in FIG. 2, $\tau_h$ is estimated to be 16.5 minutes. The heat sink temperatures and internal ambient temperatures at time indices −k and 0 are identified (steps 1424 and 1426). The elapsed time Δt' is estimated by Equation 11 (step 1428).

$$\Delta t' = \max\left[-\log\left(\frac{T_h(0) - T_a(0)}{T_h(-k) - T_a(-k)}\right)\tau_h, 0\right] \quad \text{Equation 11}$$

Equation 5-Equation 7 are used to compute the model parameters for the elapsed time Δt' (step 1430). The initial platen temperature is then obtained by Equation 12 (step 1432).

$$T_p(0)=\alpha_p(\Delta t')T_p(-k)+\alpha_h(\Delta t')T_h(-k)+\alpha_a(\Delta t')T_a(-k) \quad \text{Equation 12}$$

Figure 5:
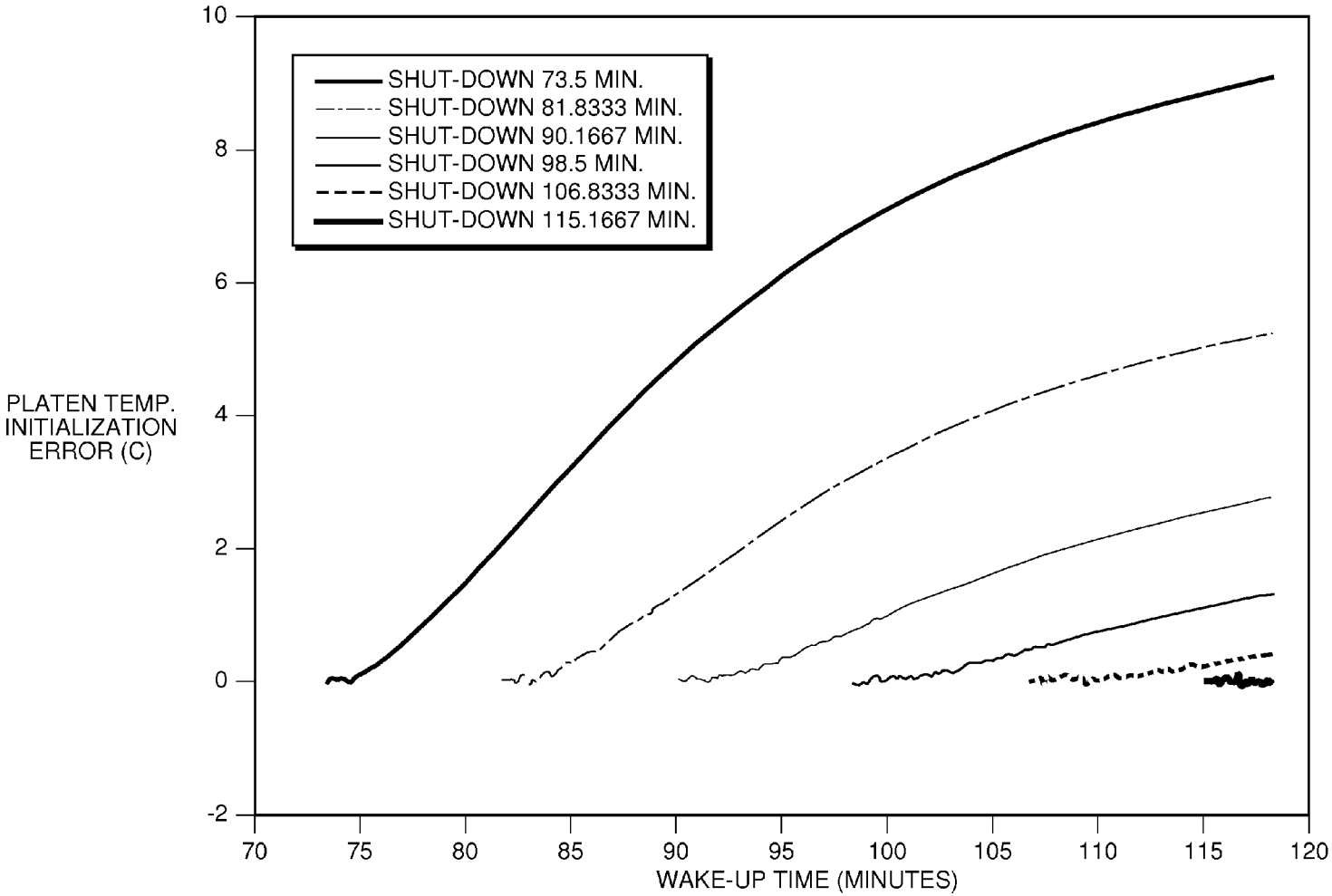
FIG. 5 is another graph of the initialization error in the platen temperature model for the case shown in FIG. 2 according to one embodiment of the present invention.

FIG. 5 shows the initialization error using this algorithm for the case shown in FIG. 2. The errors are quite large, as compared to the previous algorithm shown in FIG. 4, for early shut-down after active printing and late wake-up times. The problem is that the parameter scaling formulae derived above (Equation 5-Equation 7) assume that the heat-sink temperatures stay constant in the sampling interval, when in fact the heat sink temperature may decay, such as when the heat-sink is hot at shut-down and the time elapsed between wake-up and shut-down is large. Indeed, as seen from FIG. 5, the error is small when either Δt' is small or the shut-down time is 25 minutes after the last print. As a result, the model overestimates the platen temperature.

Figure 14C:
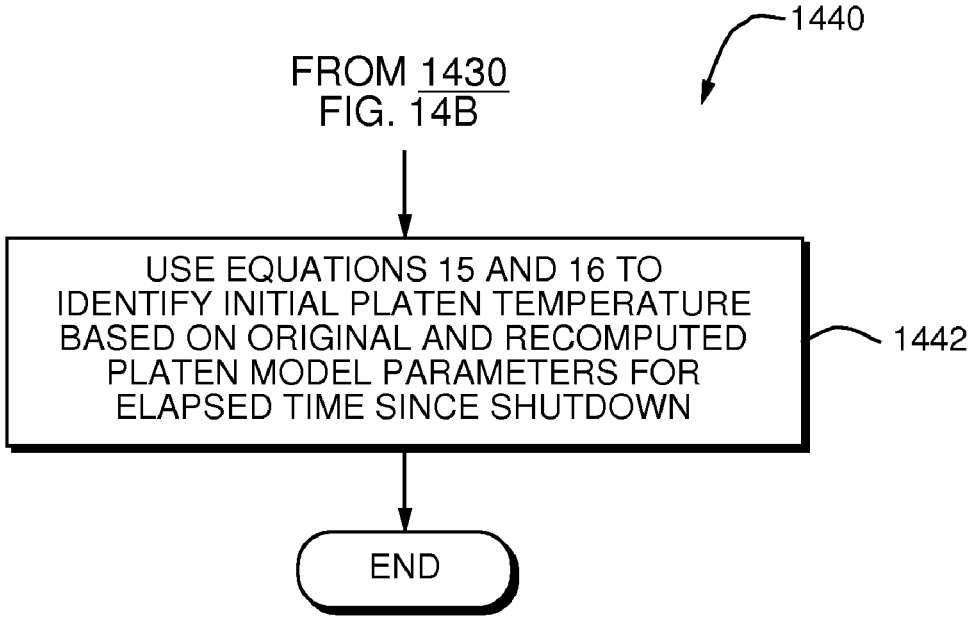

The initialization algorithm may be improved by modeling the temperature decay of the heat-sink 1006, as shown in the method 1440 of FIG. 14C rather than assuming it to be constant (as in method 1420). Rewriting Equation 3 in terms of the shut-down and wake-up time indices and assuming $T_a$ to be constant between shut-down and wake-up time results in Equation 13. If $T_a$ is not constant, then average of $T_a(-k)$ and $T_a(0)$ may be used in place of a constant value for $T_a$ in Equation 13.

$$T_p(0) = \alpha_p^k T_p(-k) + \alpha_h \sum_{m=0}^{k-1} \alpha_p^{k-1-m} T_h(m-k) + \frac{1-\alpha_p^k}{1-\alpha_p}\alpha_a T_a \quad \text{Equation 13}$$

During the shut-down period when we are unable to sample the heat-sink temperature $T_h$, we model it according to Equation 14.

$$T_h(m-k) = T_a + (T_h(-k) - T_a)e^{\frac{-m\Delta t}{\tau_h}}, \quad m = 0, \ldots, k-1 \quad \text{Equation 14}$$

Substituting Equation 14 into Equation 13, we obtain Equation 15.

$$\begin{aligned} T_p(0) &= \alpha_p^k T_p(-k) + \\ &\quad \alpha_h(T_h(-k) - T_a)\sum_{m=0}^{k-1} \alpha_p^{k-1-m} e^{\frac{-m\Delta t}{\tau_h}} + \\ &\quad \frac{1-\alpha_p^k}{1-\alpha_p}(\alpha_a + \alpha_h)T_a \\ &= \alpha_p(\Delta t')T_p(-k) + \alpha_{rh}[T_h(-k) - T_a] + \\ &\quad [\alpha_a(\Delta t') + \alpha_h(\Delta t')]T_a, \end{aligned} \quad \text{Equation 15}$$

The parameter $\alpha_{rh}$ in Equation 15 is given by Equation 16.

$$\begin{aligned} \alpha_{rh} &= \alpha_h \sum_{m=0}^{k-1} \alpha_p^{k-1-m} e^{\frac{-m\Delta t}{\tau_h}} \\ &= \alpha_h \alpha_p^{k-1} \frac{1-\alpha_p^{-k} e^{\frac{-\Delta t'}{\tau_h}}}{1-\alpha_p^{-1} e^{\frac{-\Delta t}{\tau_h}}}. \end{aligned} \quad \text{Equation 16}$$

The method 1440 of FIG. 14C may therefore operate in the same manner as steps 1422-1430 of method 1420 of FIG. 14B, except that the method 1440 of FIG. 14C may use Equation 15 and Equation 16 to identify the initial platen temperature (FIG. 14C, step 1442). Note that although Equation 15 uses the recomputed parameter values for update time interval Δt', Equation 16 uses the original parameter values for update time interval Δt.

Figure 6:
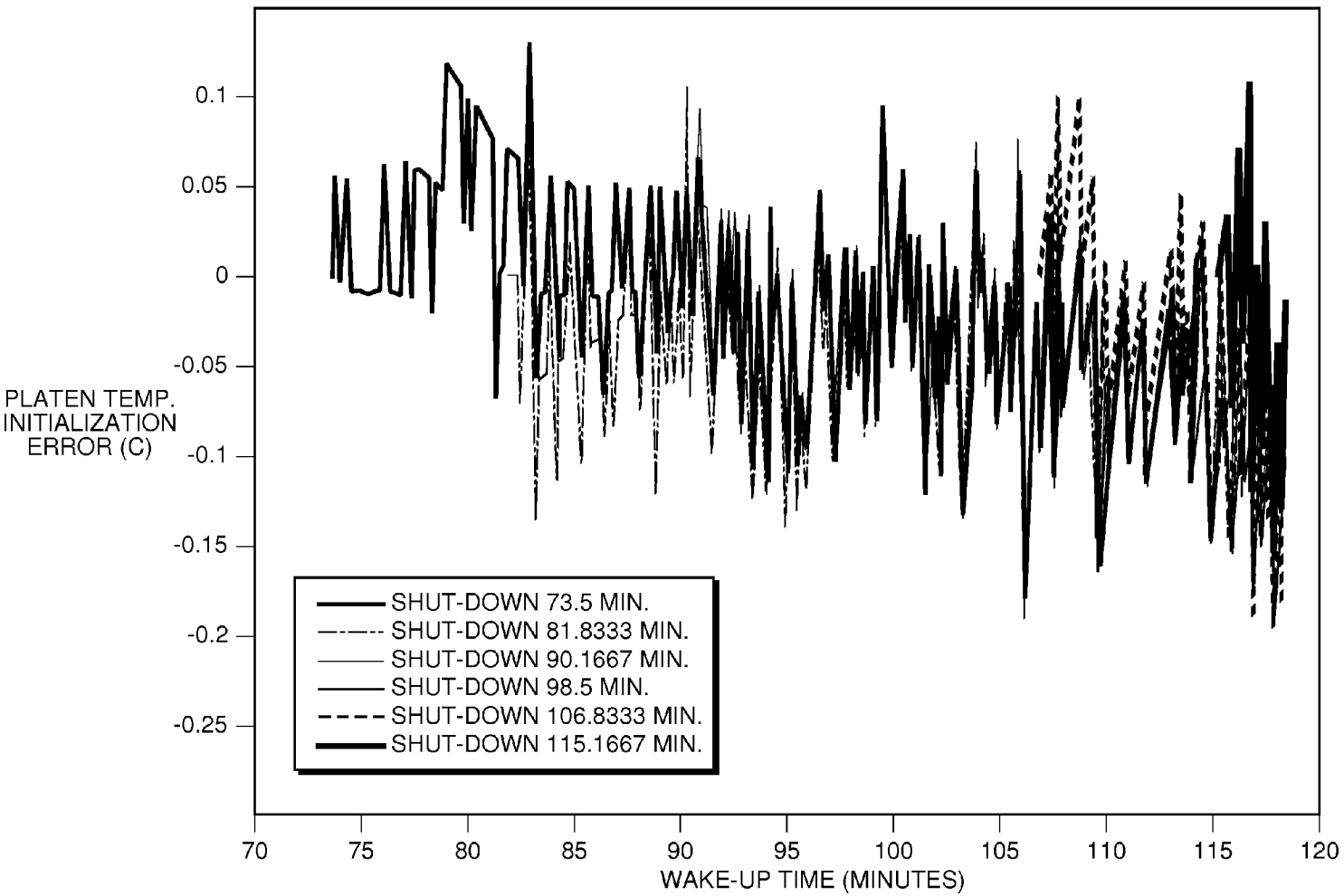
FIG. 6 is another graph of the initialization error in the platen temperature model for the case shown in FIG. 2 according to one embodiment of the present invention.

FIG. 6 shows the initialization error using Equation 15. The errors are quite small independent of the shut-down and wake-up time, indicating that the assumption of the heat-sink temperature decaying with a single time constant during idling is a good one.

Figure 15A:
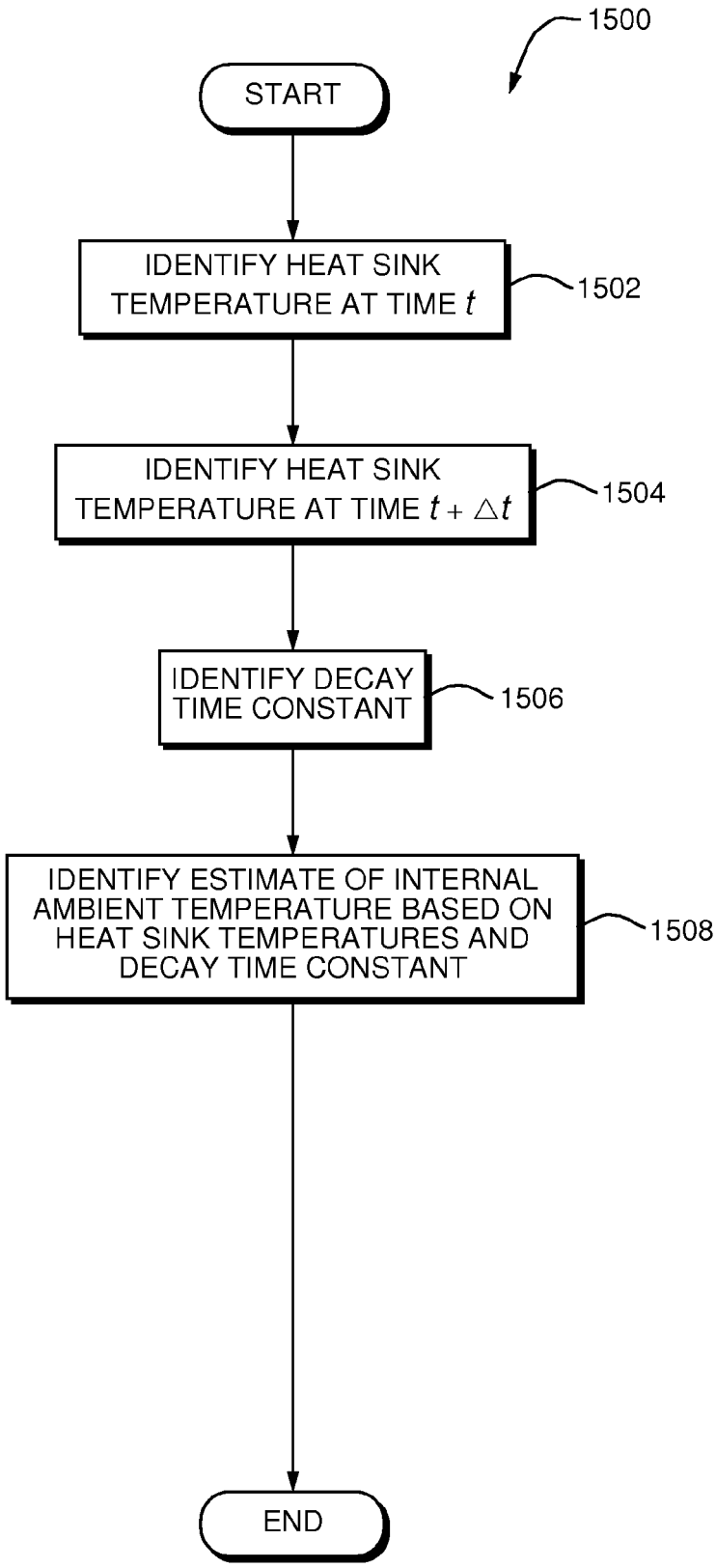
FIG. 15A is a flowchart of a method for estimating the printer's internal ambient temperature according to one embodiment of the present invention.

The platen temperature model given by Equation 1 requires the internal ambient temperature $T_a(n)$, which primarily controls the cooling of the platen 1014. This internal ambient temperature may be interpreted as a combination of the temperature of the surrounding air 1016 and the core temperature of the platen 1014. A dedicated sensor (not shown) may be used to measure the internal ambient temperature. However, depending on the construction of the printer 1002, the internal temperature may vary from one point to another and the sensor may not measure the temperature most relevant to the platen temperature prediction. In this case, it may be better to use a model for the internal ambient temperature $T_a(n)$, with the goal of achieving the best possible platen temperature prediction. Referring to FIG. 15A, a flowchart is shown of a method 1500 for implementing such a model.

In the embodiment illustrated in FIG. 15A, the heat sink temperature may be used to estimate the temperature inside the printer 1002 when no heat is being supplied by the print head 1008. More specifically, the heat sink temperature at times t and t+Δt may be identified (steps 1502 and 1504). During periods of inactivity, the single time constant model of Equation 14 may used to estimate $T_a$ by identifying the decay time constant (step 1506) and using Equation 17 to identify an estimate $\hat{T}_a(t)$ of the internal ambient temperature at time t (step 1508).

$$\hat{T}_a(t) = \frac{T_h(t+\Delta t) - e^{\frac{-\Delta t}{\tau_h}} T_h(t)}{1 - e^{\frac{-\Delta t}{\tau_h}}} \qquad \text{Equation 17}$$

Figure 7:
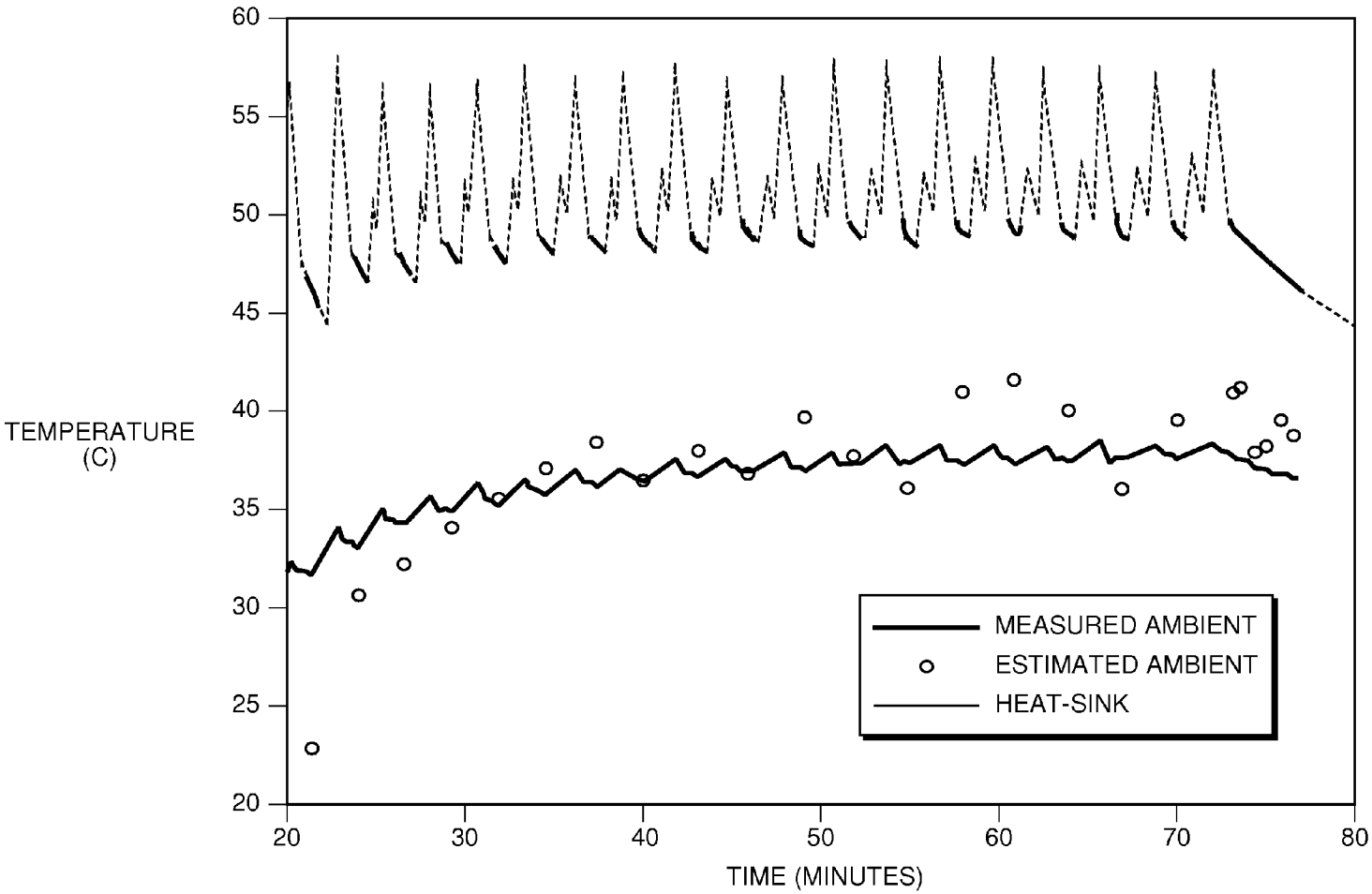
FIG. 7 is a graph illustrating the performance of an algorithm for estimating an internal ambient thermal printer temperature according to one embodiment of the present invention.

Better results may be obtained if one allows some time to elapse after active printing before applying Equation 17 in order for the single time constant model to be valid. Even then, the estimate may be very noisy. Since $T_a$ is typically very slow varying, the estimate provided by Equation 17 may be averaged over relatively long periods of time to reduce noise. FIG. 7 shows how well this algorithm performs for the data set shown in FIG. 2. There is only a short period of inactivity between prints in this data set, so the waiting period after printing is rather limited. The solid portion of the heat-sink trace superimposed on the complete trace shown as a dotted line indicates what portion of the heat-sink temperature was used to perform the internal ambient temperature estimation. Equation 17 was applied multiple times during these periods of inactivity with varying Δt's and then median filtered to obtain the estimates shown in FIG. 7. Application of smoothing over longer time periods for the internal ambient temperature estimator should give an accurate, smoothly varying estimate.

A model similar to the platen model is employed to predict the internal ambient temperature. The heat sink temperature is used as an indicator of the amount of heat being generated inside the printer 1002. More specifically, the heat sink temperature at time interval n−1 may be identified. The external ambient $\overline{T}_a$ temperature is identified and used as an indicator for the cooling of the printer 1002. Parameters $\overline{\alpha}_h$ and $\overline{\alpha}_a$ of the internal ambient temperature model may be identified using techniques similar to those described above for estimating the corresponding parameters $\alpha_h$ and $\alpha_a$ of the platen temperature model 1100. Following the same reasoning as the platen temperature model specified above, the update equation for the internal ambient temperature is given by Equation 18, which may be used to update the internal ambient temperature at time n. This ambient temperature model may be used to identify the internal ambient temperature in step 1210 of the method 1200 shown in FIG. 12.

$$\begin{aligned} T_a(n) &= T_a(n-1) + \overline{\alpha}_h(T_h(n-1) - T_a(n-1)) + \overline{\alpha}_a(\overline{T}_a - T_a(n-1)) \\ &= \overline{\alpha}_p T_a(n-1) + \overline{\alpha}_h T_h(n-1) + \overline{\alpha}_a \overline{T}_a \end{aligned} \qquad \text{Equation 18}$$

As in the platen model, $\overline{\alpha}_p$ is defined by Equation 19.

$$\overline{\alpha}_p = 1 - \overline{\alpha}_a - \overline{\alpha}_h \qquad \text{Equation 19}$$

Figure 8:
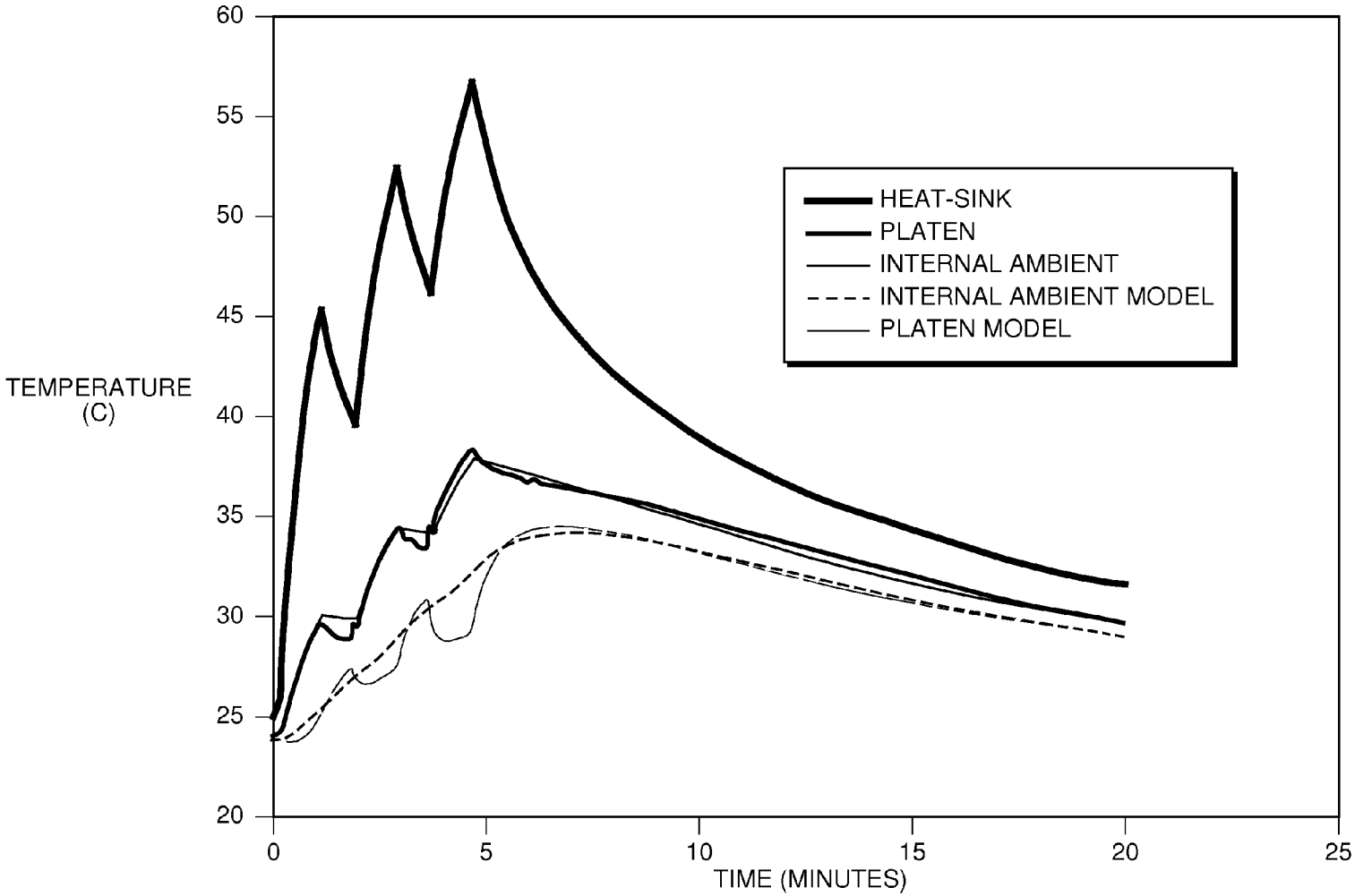
FIG. 8 is a graph showing performance of the platen model using a model for the internal ambient temperature according to one embodiment of the present invention.

FIG. 8 shows another data set with heat sink, platen and internal ambient measurements made on a portable printer. Three prints were made sequentially with some idle time in between the prints before the printer 1002 was allowed to cool. The data are relatively high-resolution with a sampling interval of 2 seconds. The internal ambient temperature model and platen model parameters 1102 were optimized to obtain the best possible prediction for the platen temperature. FIG. 8 shows estimates of the internal ambient temperature using the internal ambient model (Equation 18) and the platen model (Equation 1) using the heat sink temperature and the estimated internal ambient temperature $T_a$, with the external ambient temperature $\overline{T}_a$ fixed at 24 C. The platen temperature prediction is a good fit to the measurement even though the internal ambient model is not a good fit to the internal ambient temperature. It turns out that the internal ambient measurement sensor in these measurements is not located in a position that is relevant to the cooling of the platen 1014. By modeling the internal ambient temperature to obtain the best platen temperature prediction, we can obtain a smaller error than using the raw ambient measurement.

Figure 9A:
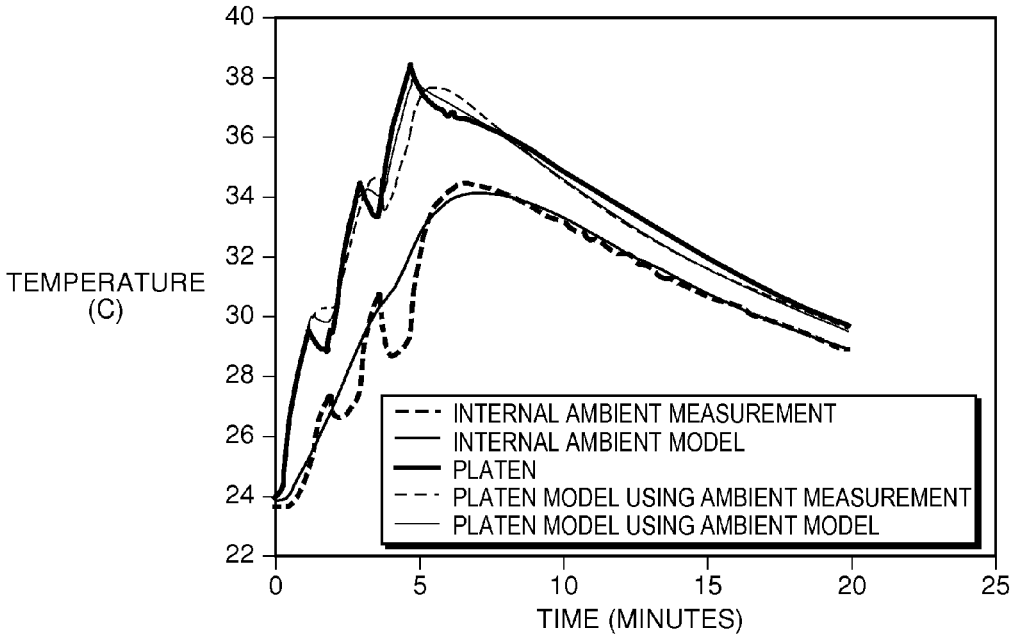
FIGS. 9A and 9B are graphs illustrating platen temperature predictions using actual internal ambient temperature measurements and modeled internal ambient temperatures according to one embodiment of the present invention.
Figure 9B:
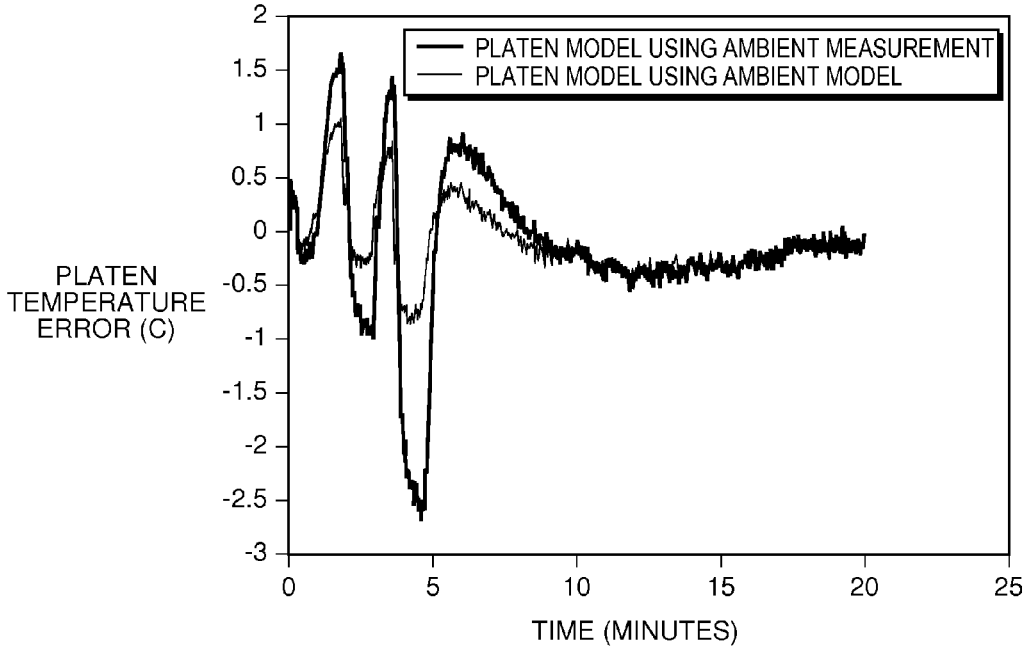
Figure 10:
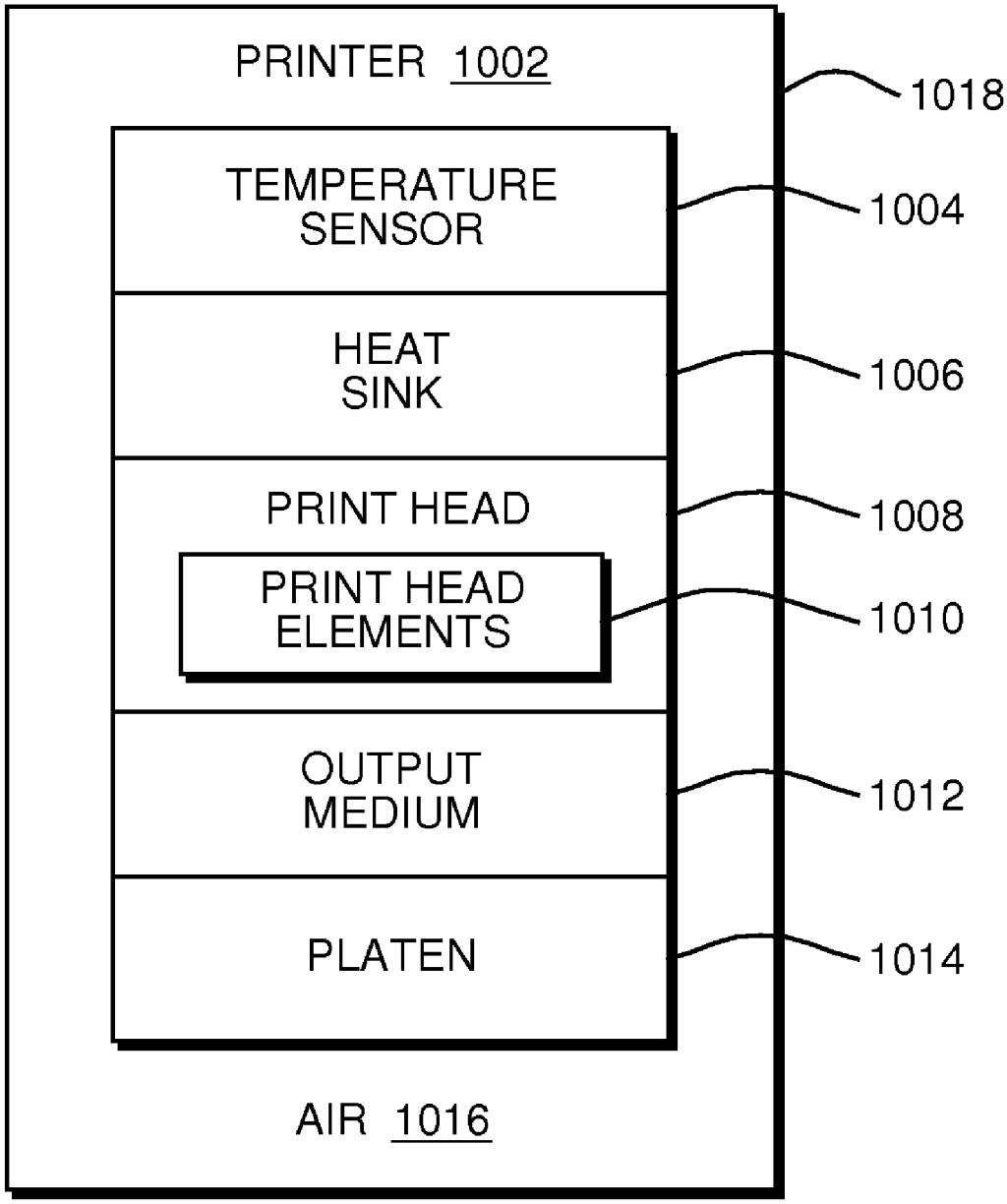
FIG. 10 is a block diagram of a thermal printer.

FIG. 9 explores this by running the platen model using either the raw internal ambient measurements or the modeled internal ambient temperature. It is seen that platen temperature prediction using the raw measurements are inferior to that using the modeled internal ambient. In particular, FIG. 9B shows the platen prediction error is within a degree C in the case of the modeled internal ambient.

Figure 15B:
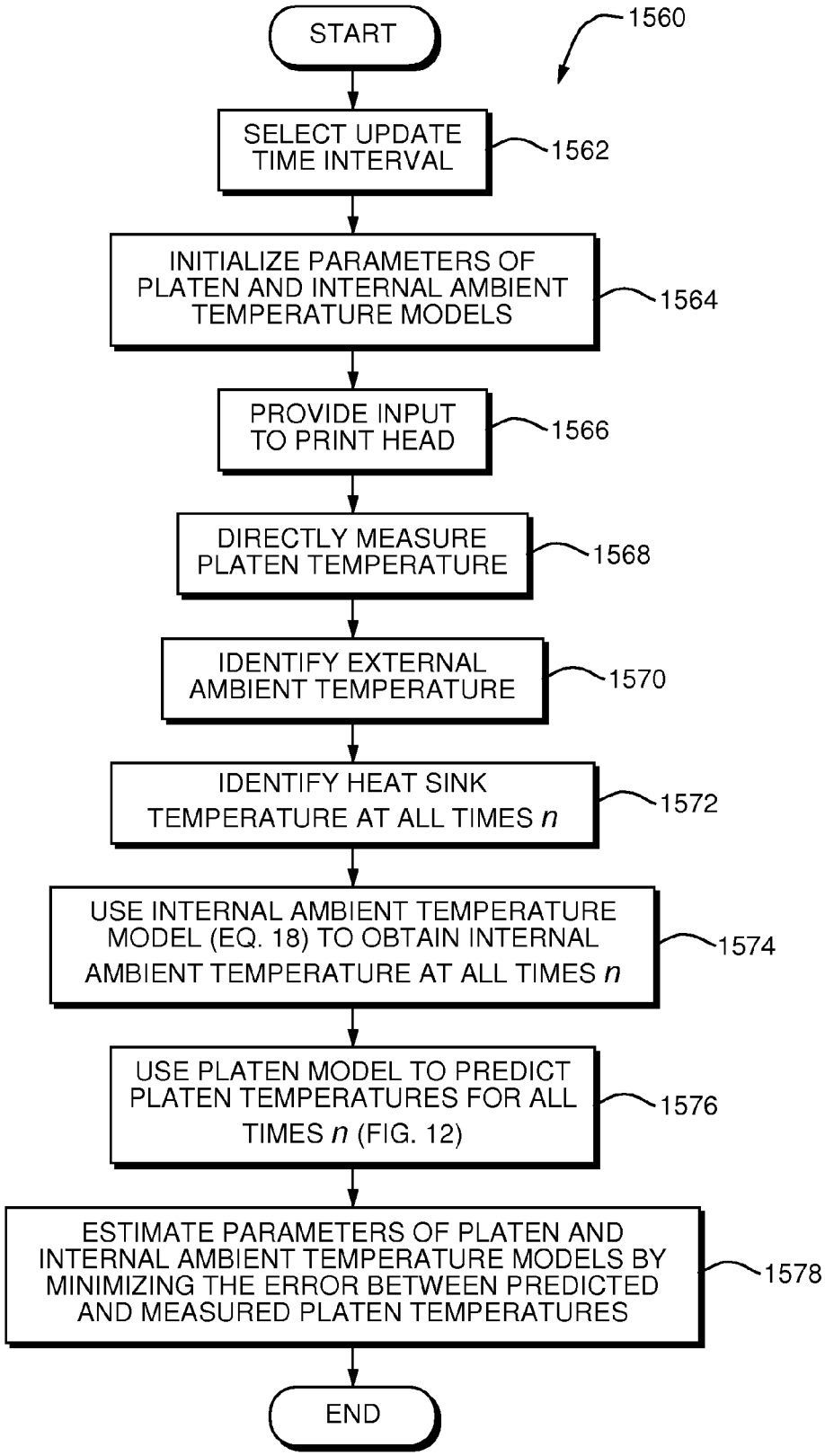
FIG. 15B is a flowchart of a method for estimating parameters of a platen model using a modeled internal ambient temperature according to one embodiment of the present invention.

Referring to FIG. 15B, a flowchart is shown of a method 1560 for estimating the parameters of the internal ambient temperature model and the platen temperature model ($\alpha_h$, $\alpha_a$, $\overline{\alpha}_h$, and $\overline{\alpha}_a$) according to another embodiment of the present invention. In this embodiment, the internal ambient temperature $T_a$ is estimated based on the external ambient temperature $\overline{T}_a$ the heat sink temperature $T_h$, and the platen temperature $T_p$.

More specifically, an update time interval Δt is selected (step 1562). Initial values of the parameters $\alpha_h$ and $\alpha_a$ of the platen model and parameters $\overline{\alpha}_h$ and $\overline{\alpha}_a$ of the internal ambient temperature model are selected (step 1564). Input energies are provided to the print head 1008 to cause it to produce output on the output medium 1012 (step 1566). During the course of printing, the temperature $T_p$ of the platen 1014 is directly measured (step 1568). The external ambient temperature $\overline{T}_a$ and heat sink temperature are identified at all time instances nΔt (steps 1570 and 1572). The internal ambient temperature model of Equation 18 is used to obtain a prediction of the internal ambient temperature at all time instances nΔt (step 1574). The platen model is used to predict the platen temperature $T_p$ for all time instances $n\Delta t$, according to the method of FIG. 12 (step 1576).

Parameters $\alpha_h$, $\alpha_a$, $\overline{\alpha}_h$, and $\overline{\alpha}_a$ may be estimated by minimizing the error between the platen temperature measurement of step 1568 and the modeled platen temperature identified in step 1576 (step 1578).

Once the platen temperature has been estimated, it may be used to compensate for the input energies provided to the print head 1008. Embodiments of two methods for adjusting the input energies based on the estimated platen temperature will be described. In general, in the first method, the estimated platen temperature is used to modify an estimate of the print head temperature, and the modified print head temperature is then provided as input to a thermal history control algorithm to produce a modified input energy to provide to the print head. In general, in the second method, the thermal history control algorithm is applied using the original (unmodified) estimate of the print head temperature, and the estimated platen temperature is then used to modify the input energy that is output by the thermal history control algorithm.

More specifically, the first method may be performed as follows. First, the estimated platen temperature is used to modify an estimate of the print head temperature. This platen temperature correction may be performed in a manner similar to the initial temperature compensation of the medium (the ambient temperature to which the medium is exposed) since platen temperature also affects the bulk temperature of media. For example, previously we have shown that the ambient temperature variation of the medium may be compensated for by modifying the heat-sink temperature used by a thermal history control (THC) algorithm. (See U.S. Pat. No. 7,295,224, issued on Nov. 13, 2007, entitled "Thermal Response Correction System.") For example, Equation 20 may be used to correct the heat-sink temperature based on the platen temperature.

$$T_h' = T_h + f_p(T_p - T_{pc}) \qquad \text{Equation 20}$$

The corrected heat sink temperature $T'_h$ that is output by Equation 20 may be supplied to the THC algorithm to produce an input energy that reflects the estimated platen temperature. In Equation 20, $T_{pc}$ is the platen temperature at which the THC algorithm is calibrated, and $f_p$ is the platen correction factor that controls the effective contribution of platen temperature to the heat-sink temperature. Note that heat sink temperature is merely one example of a temperature that may be used by the thermal history control algorithm. More generally, any temperature within the thermal printer may be used for the same purpose.

Figure 16A:
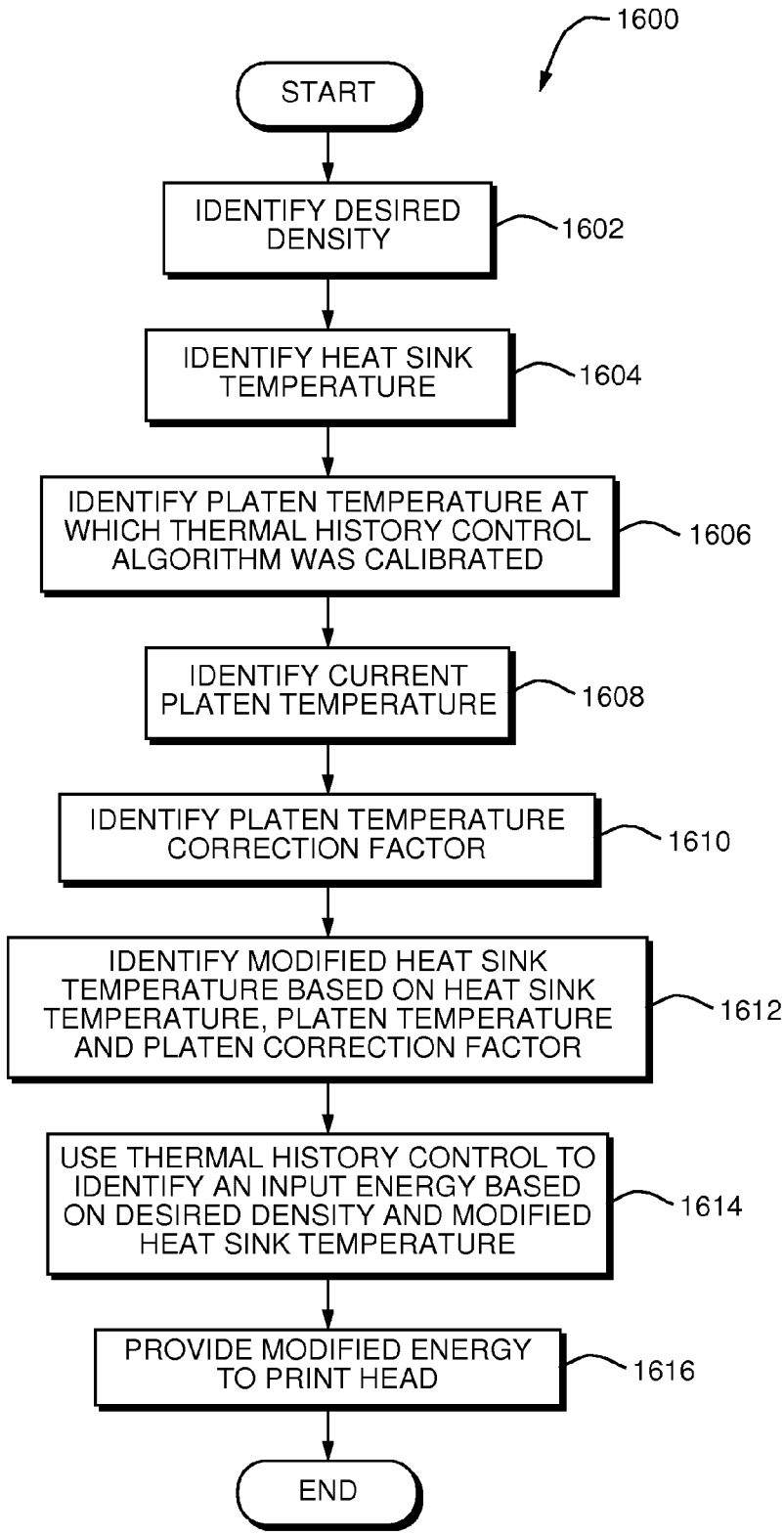
FIGS. 16A-16B are flowcharts of methods for identifying an input energy to provide to a thermal print head according to embodiments of the present invention.

Referring to FIG. 16A, a flowchart is shown of a method 1600 for modifying an input energy provided to the print head 1008 in accordance with Equation 20. The method 1600 identifies a desired density to be printed (step 1602). The method 1600 identifies the temperature of the heat sink 1006 (step 1604), the platen temperature at which the thermal history control algorithm was calibrated (step 1606), and the current platen temperature (step 1608).

The method 1600 identifies a platen correction factor (step 1610). Examples of techniques by which the platen correction factor may be estimated will be described below. The method 1600 identifies the modified heat sink temperature based on the original heat sink temperature and the platen correction factor (Equation 20) (step 1612). The THC algorithm is used to identify an input energy based on the desired density and the modified heat sink temperature (step 1614). The input energy is provided to the print head 1008 (step 1616).

Figure 16B:
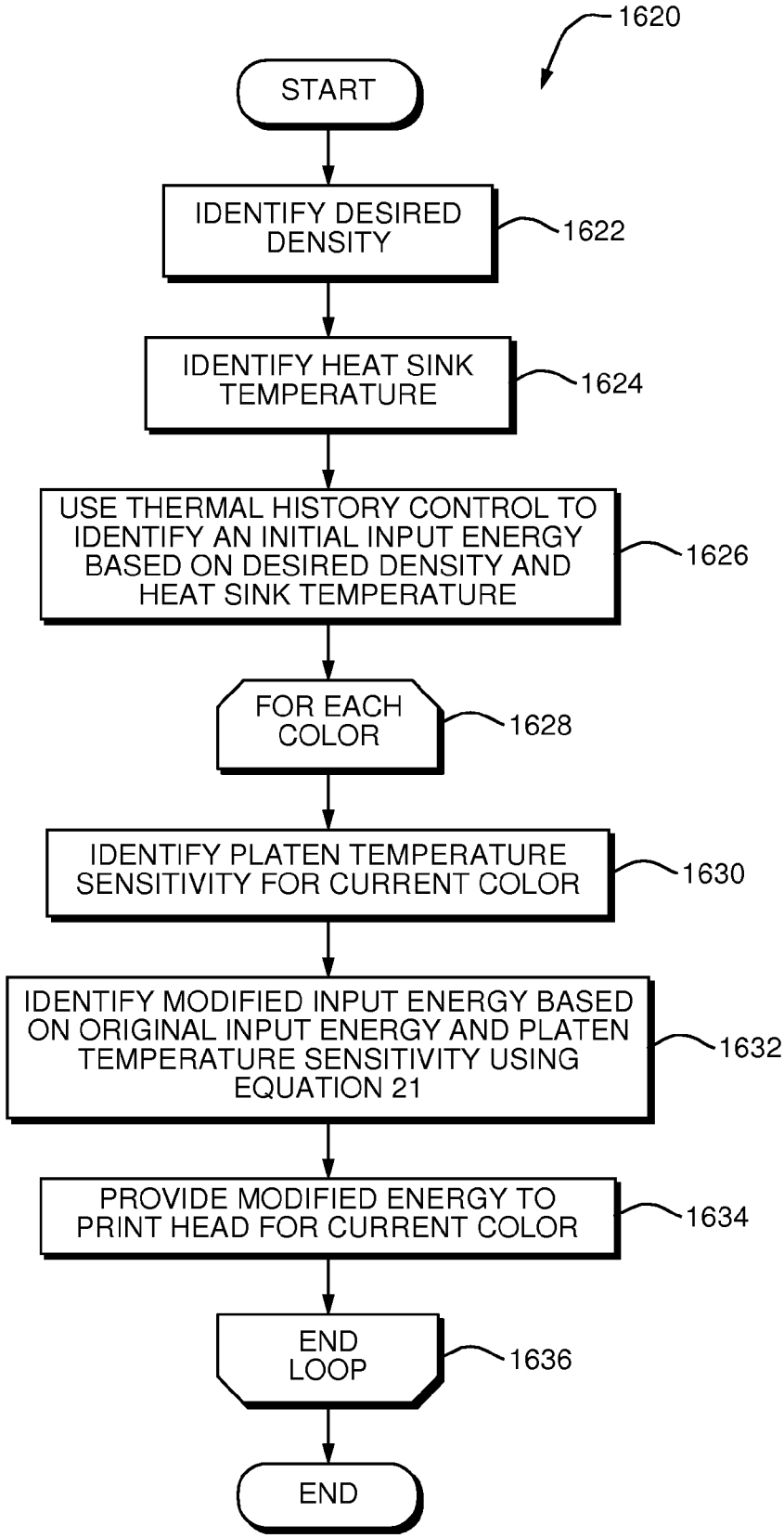

Referring to FIG. 16B, a flowchart is shown of another method 1620 for modifying an input energy provided to the print head 1008. In this method 1620, the thermal history control algorithm is applied using the unmodified print head temperature to produce an initial input energy E(D), where D is the desired print density. The initial energy is modified using Equation 21, where $S_p(D)$ is the sensitivity to the platen temperature. Such a method may be useful, for example, in conjunction with a multicolor printer, in which it is desirable to perform platen temperature correction separately for each color after the thermal history control algorithm produces an initial input energy.

$$E'(D) = E(D) + S_p(D)(T_p - T_{pc}) \qquad \text{Equation 21}$$

More specifically, the method 1620 identifies a desired density to be printed (step 1622) and the temperature of the heat sink 1006 (step 1624). The thermal history control algorithm is used to identify an initial input energy based on the desired density and the heat sink temperature (step 1626).

Then, for each color (step 1628), the method 1620 identifies a platen temperature sensitivity for the current color (step 1630). Examples of ways of which different platen temperature sensitivities may be identified for different colors will be described below. The method 1620 identifies a modified input energy based on the original input energy (from step 1626) and the platen temperature sensitivity using Equation 21 (step 1632).

The method 1620 provides the modified input energy to the print head for the current color (step 1634). Steps 1630-1634 are repeated for the remaining colors (step 1636).

Figure 17A:
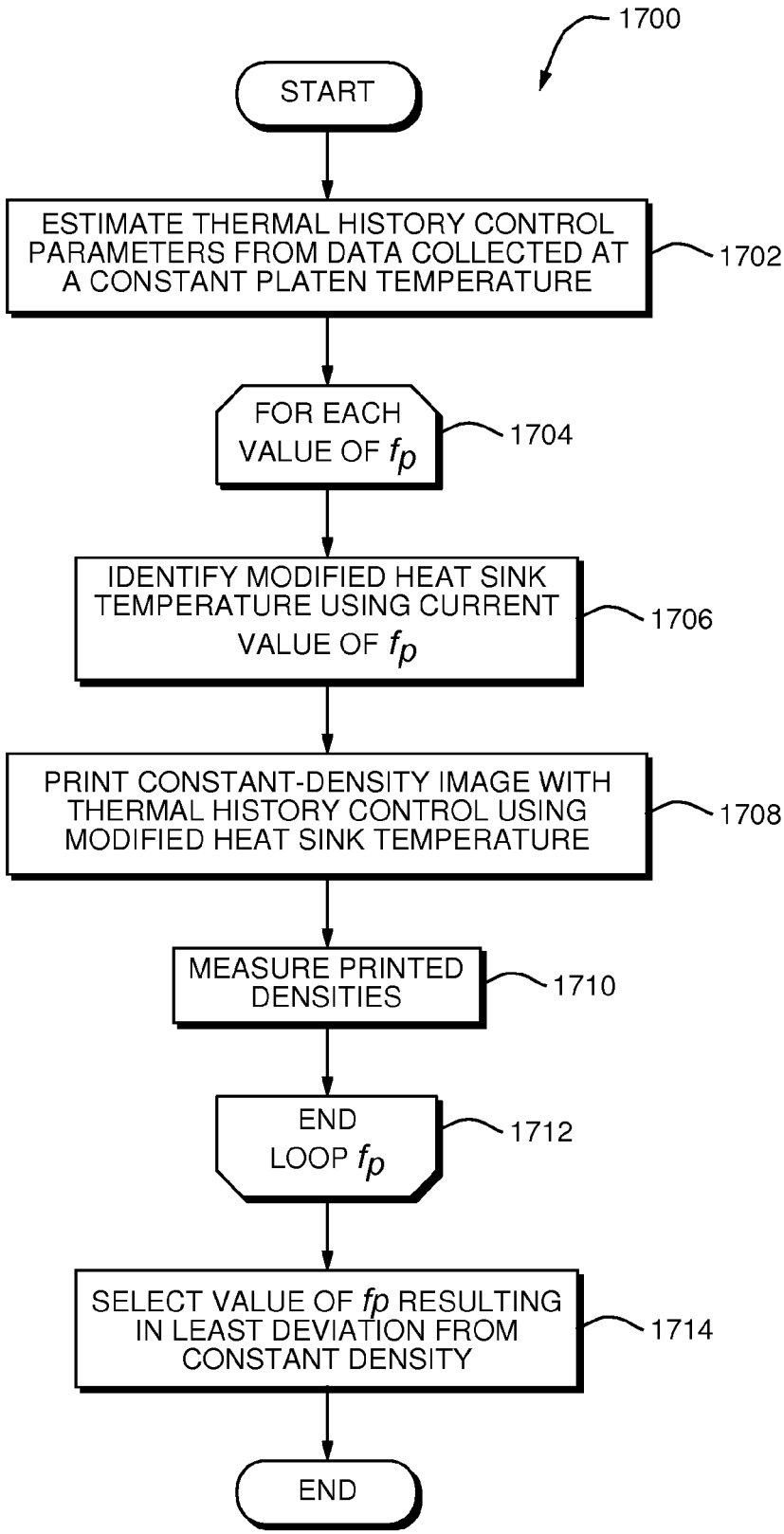
FIGS. 17A-17C are flowcharts of methods for estimating platen temperature correction parameters according to one embodiment of the present invention.
Figure 17B:
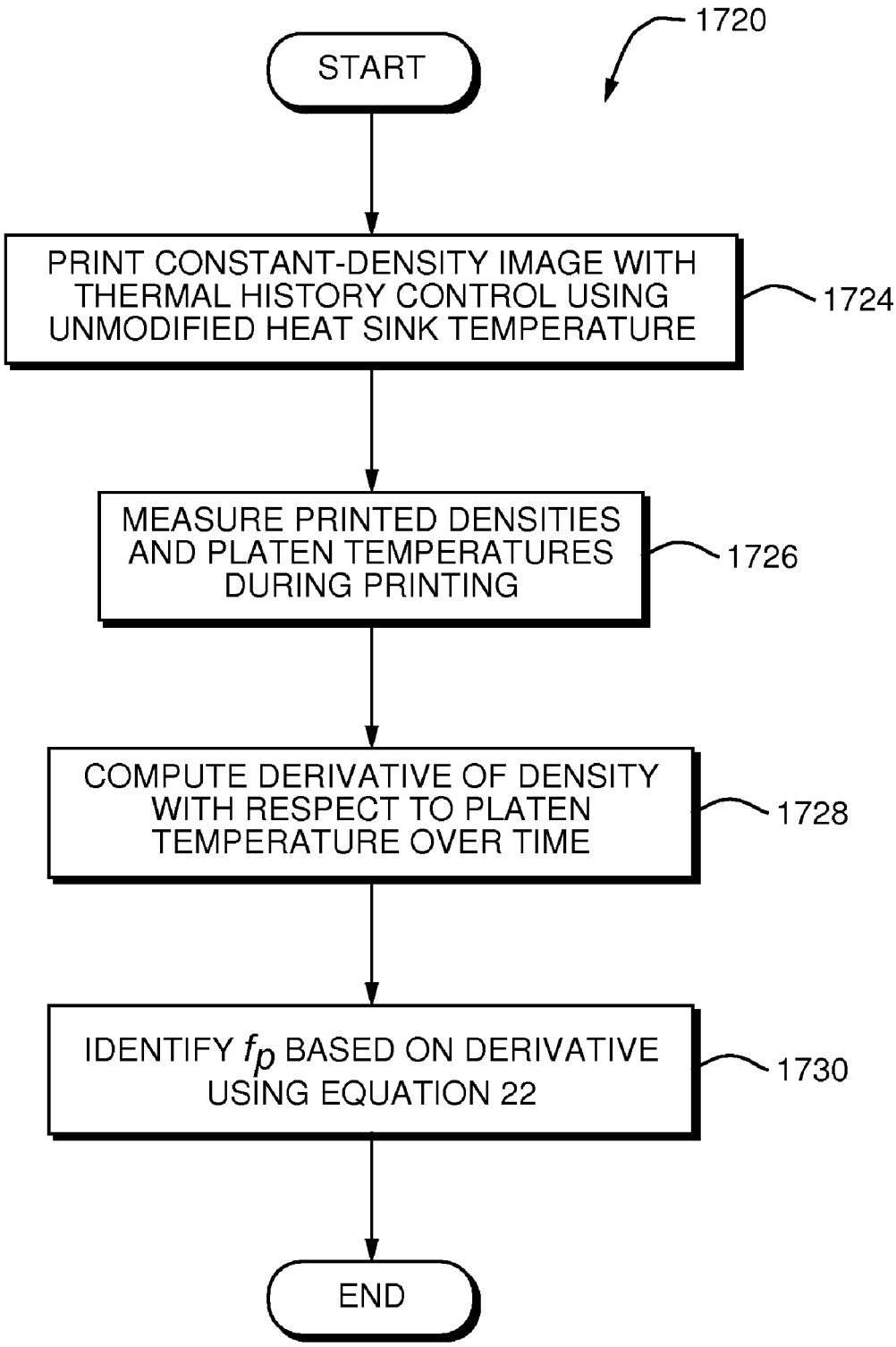
Figure 17C:
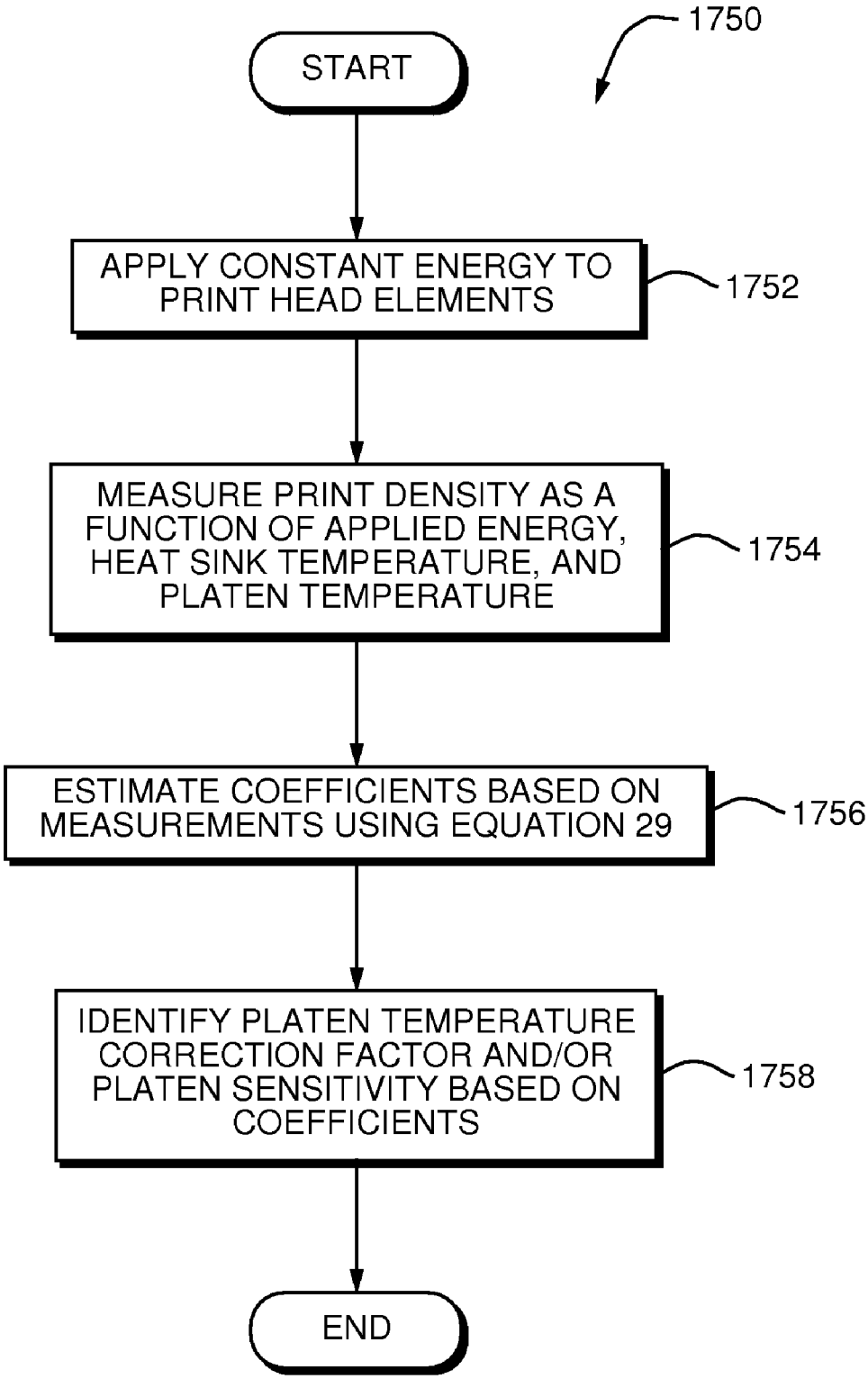

Referring to FIGS. 17A-17C, examples of two distinct methods will be described by which parameters for platen temperature correction (e.g., $f_p$ or platen temperature sensitivity) may be estimated, depending on how the data for estimating the THC parameters are acquired. The first method is conceptually simpler but harder to practice. It requires the data for estimating all the THC parameters are acquired at a constant platen temperature. This essentially decouples the rest of the thermal history effects from the platen effects. The platen correction factor $f_p$ is then estimated in a subsequent step by using the printer 1002 to print output with THC turned on to actively compensate for the all thermal history effects. By varying the platen temperature in the second step, the correction factor $f_p$ can be determined. The requirement of holding the platen temperature constant during the data collection of the first step is typically very hard to achieve, especially on a portable printer where the small mass of the platen makes it difficult to hold at a fixed temperature.

The second method is conceptually harder but easier to practice. In this method, the data are collected by varying the platen temperature in addition to all the factors affecting the thermal history in the printer 1002. The THC parameters, such as sensitivity to the heat sink temperature, are now coupled with the platen correction parameters, such as $f_p$, or platen temperature sensitivity, which controls the sensitivity to platen temperature. The estimation of platen correction parameters is performed simultaneously with the rest of THC parameters. These two methods will now be described in more detail.

According to a first embodiment 1700 of the first method for estimating $f_p$, the parameter estimation process is divided into two steps. In the first step, the print density data are collected by varying all factors that affect thermal history in the printer 1002, except that the platen temperature is kept fixed at $T_{pc}$. These data are used to determine all the THC parameters (step 1702). In the second step, a plurality of different values of $f_p$ are tried (step 1704). For each value of $f_p$, the heat sink temperature is modified based on the value of $f_p$ Equation 20 (step 1706). A constant-density image is printed, with thermal history control using the modified heat sink temperature to compensate for all thermal history effects (step 1708). The resulting printed densities are measured (step 1710). Steps 1706-1710 are repeated for all desired values of $f_p$ (step 1712). The value of $f_p$ which resulted in a printed image with densities that are closest to constant is selected (step 1714). If none of the tried values result in good compensation, an intermediate value may be chosen by interpolation between the tried values.

Referring to the method 1720 of FIG. 17B, the second embodiment of the first method involves printing a constant-density image with thermal history control using an unmodified heat sink temperature (step 1724). This corrects for variations of all thermal history effects except for the platen temperature. The printed densities and the platen temperature are measured over time as the image is printed (step 1726). The derivative $dD/dT_p$ is computed using data from step 1726 (step 1728). The relationship between the slope of the measured density versus platen temperature, $dD/dT_p$, and $f_p$ may be obtained by applying the chain rule to the definition of the platen correction factor as shown in Equation 22 (step 1730).

$$f_p = \left.\frac{dT_h}{dT_p}\right|_D = \frac{dT_h}{dE}\frac{dE}{dD}\frac{dD}{dT_p} = \frac{1}{S_e(D)}\frac{d\Gamma^{-1}(D)}{dD}\frac{dD}{dT_p} \qquad \text{Equation 22}$$

In Equation 22, $S_e(D)$ and $\Gamma(D)$ are the effective sensitivity and gamma curve respectively employed by the THC algorithm at density D, as described in more detail in U.S. patent application Ser. No. 11/332,530, filed on Jun. 13, 2006, entitled, "Printer Thermal Response Calibration System." Note that $f_p$ is independent of print density even though each of its constituent factors are functions of density. If the correction model accurately describes the observations, these density dependencies will automatically cancel out to yield a value independent of density.

According to the second method 1750 (FIG. 17C) for estimating the platen correction parameters, $f_p$ and the platen temperature sensitivity may be estimated simultaneously along with the rest of the THC parameters from print density data collected by varying the platen temperature as well as other factors affecting thermal history, such as heat sink temperature and energies applied to the print head 1008. In the following exposition, for the sake of simplicity, we only consider a monochrome THC model to derive the simultaneously parameter estimate scheme. The same technique may easily be applied to the multi-color case by printing only one color at a time, i.e., zero energies supplied for printing the other colors.

The calibration data are collected by applying a constant energy to the print elements for N>>1 pixels (step 1752) and then measuring the print density as a function of applied energy, heat sink temperature, and the platen temperature (step 1754). Steps 1752 and 1754 may be repeated for a variety of energies to produce measurements for a variety of densities. For the THC model, it can be shown that the energy to print a density D is given by Equation 23.

$$E(D)=\Gamma^{-1}(D)+S_e(D)(T_h-T_\Gamma) \qquad \text{Equation 23}$$

In Equation 23, the $T_\Gamma$ denotes the heat sink temperature at which $\Gamma(\cap)$ is measured and $S_e$ is the sensitivity to the heat sink temperature, known as "effective sensitivity." Both $\Gamma(\cap)$ and $S_e$ are parameters of the media model of THC that need to be estimated from the data. For the derivation of Equation 23 from the media and thermal models of THC, refer to U.S. patent application Ser. No. 11/332,530, filed on Jun. 13, 2006, entitled, "Printer Thermal Response Calibration System."

Substituting the modified heat sink temperature of Equation 20 into Equation 23, we obtain Equation 24.

$$E(D)=C(D)+S_e(D)T_h+S_p(D)(T_p-T_{pc}) \qquad \text{Equation 24}$$

In Equation 24, $S_p$ denotes the sensitivity to platen temperature, given by Equation 25 and C(D) is given by Equation 26.

$$S_p(D)=f_pS_e(D) \qquad \text{Equation 25}$$

$$C(D)=\Gamma^{-1}(D)-S_e(D)T_\Gamma. \qquad \text{Equation 26}$$

Equation 24 is a linear equation for any density D that relates the energy to the heat sink and platen temperature. The coefficients C, $S_e$ and $S_p$ may be estimated by a multi linear regression that solves Equation 24 in a least squares sense for the measured data points (step 1756). Let M measurements be made at each density. In the following treatment, the density dependence of the coefficients will sometimes be suppressed for notational simplicity. Let $\{E_m, T_{hm}, T_{pm}\}$, m=1, . . . , M, denote the set of M measured data points with each triplet comprising the energy required to print a particular density at the measured heat sink and platen temperature. Then Equation 24, evaluated at each of the M data points, can be written as a set of M equations in a vector-matrix notation as given by Equation 27 and Equation 28.

$$\vec{E} = A\begin{pmatrix} C \\ S_e \\ S_p \end{pmatrix} \qquad \text{Equation 27}$$

$$\vec{E} = \begin{pmatrix} E_1 \\ \vdots \\ E_M \end{pmatrix} \text{ and } A = \begin{pmatrix} 1 & T_{h1} & T_{p1}-T_{pc} \\ \vdots & \vdots & \vdots \\ 1 & T_{hM} & T_{pM}-T_{pc} \end{pmatrix} \qquad \text{Equation 28}$$

The least squares estimate of the coefficients are given by Equation 29.

$$\begin{pmatrix} \hat{C} \\ \hat{S}_e \\ \hat{S}_p \end{pmatrix} = (A^TA)^{-1}A^T\vec{E} \qquad \text{Equation 29}$$

Using Equation 25, we obtain the estimate of $f_p$ and/or the platen temperature sensitivity (step 1758). (Note that step 1630 of method 1620 may identify the platen temperature sensitivity using the estimate from Equation 29.) In the first method of estimating $f_p$, Equation 30 or Equation 31 may be used to obtain the estimate of $f_p$.

$$\hat{f}_p(D) = \frac{\hat{S}_p(D)}{\hat{S}_e(D)} \qquad \text{Equation 30}$$

Note that, in general, $f_p$ will be a function of density since the estimated sensitivities to heat sink and platen temperature are both functions of density. However, if the correction model given by Equation 20 is valid, the density dependence of both the sensitivities should cancel each other to yield a density independent $f_p$. In practice, due to noise and model mismatch errors, $f_p$ will typically be a function of density. To obtain a density independent estimate to use in Equation 20, we use a density weighted average, as given by Equation 31.

$$f_p = \frac{\int w(D) f_p(D) dD}{\int w(D) dD} \quad \text{Equation 31}$$

In Equation 31, w(D) assign weights to the different densities. In this manner, the correction is made more accurate for some densities than others.

Embodiments of the present invention have a variety of advantages. In general, conventional thermal printing techniques do not explicitly take into account the effects of platen temperature on print density. As a result, such techniques tend to produce artifacts caused by changes in platen temperature which are not otherwise corrected for by conventional thermal history control. Embodiments of the present invention reduce or eliminate such artifacts by explicitly compensating for the effects of changes in platen temperature.

Furthermore, embodiments of the present invention include techniques for using a model of platen temperature to predict platen temperature based on input energies and observable data. As a result, platen temperature compensation may be performed even in the absence of platen temperature readings from a sensor, thereby eliminating the cost, size, and design complexity that would be incurred by the addition of such a sensor to the thermal printer. This benefit is particularly significant in the context of small consumer printers, for which maintaining a low cost is a high priority. Furthermore, the techniques disclosed herein are flexible enough to be used in conjunction with either predicted or actual platen temperatures.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

What is claimed is:

1. A method for use with a thermal printer, the method comprising:

(A) identifying a temperature of a platen of the thermal printer; and (B) selecting an input energy to provide to a print head element of the thermal printer based on the identified temperature of the platen, wherein (B) comprises:

(B)(1) identifying a temperature within the thermal printer;

(B)(2) modifying the identified thermal printer temperature based on the platen temperature to produce a modified temperature; and (B)(3) providing the modified temperature as input to a thermal history control component to identify the input energy.

2. The method of claim 1, wherein (B) comprises:

(B)(1) identifying a preliminary energy to provide to the print head element; and (B)(2) modifying the preliminary energy based on the identified platen temperature to identify the input energy.

3. The method of claim 2, wherein (B)(1) comprises:

(B)(1)(a) identifying a temperature within the thermal printer; and (B)(1)(b) applying thermal history control using the temperature within the thermal printer to identify a preliminary energy.

4. The method of claim 1, wherein (A) comprises identifying an actual temperature of the platen.

5. The method of claim 1, wherein (A) comprises:

(A)(1) identifying an estimated temperature of the platen based on a platen temperature model.

6. The method of claim 5, wherein (A)(1) comprises identifying the estimated platen temperature based on at least one measurement of a temperature in the thermal printer.

7. The method of claim 6, wherein (A)(1) comprises identifying the estimated temperature based on a previous temperature of the platen, a temperature within the thermal printer, and an internal ambient temperature of the thermal printer.

8. The method of claim 7, wherein (A)(1) comprises identifying the estimate of the temperature based on a weighted sum of:

the previous platen temperature;

a difference between the temperature within the thermal printer and the previous platen temperature; and a difference between the internal ambient temperature and the previous platen temperature.

9. The method of claim 7, wherein the internal ambient temperature comprises a measured internal ambient temperature.

10. The method of claim 7, wherein the internal ambient temperature comprises a modeled internal ambient temperature.

11. The method of claim 10, wherein the modeled internal ambient temperature is modeled based on the temperature within the thermal printer and an external ambient temperature of the environment of the thermal printer.

12. An apparatus for use with a thermal printer, the apparatus comprising:

platen temperature identification means for identifying a temperature of a platen of the thermal printer; and input energy selection means for selecting an input energy to provide to a print head element of the thermal printer based on the identified temperature of the platen, wherein the input energy selection means comprises:

means for identifying a temperature within the thermal printer;

means for modifying the identified thermal printer temperature based on the platen temperature to produce a modified temperature; and means for providing the modified temperature as input to a thermal history control component to identify the input energy.

13. The apparatus of claim 12, wherein the input energy selection means comprises:

means for identifying a preliminary energy to provide to the print head element; and means for modifying the preliminary energy based on the identified platen temperature to identify the input energy.

14. The apparatus of claim 13, wherein the means for identifying the preliminary energy comprises:

means for identifying a temperature within the thermal printer; and means for applying thermal history control using the temperature within the thermal printer to identify a preliminary energy.

15. The apparatus of claim 12, wherein the platen temperature identification means comprises means for identifying an actual temperature of the platen.

16. The apparatus of claim 12, wherein the platen temperature identification means comprises:

means for identifying an estimated temperature of the platen based on a platen temperature model.

17. The apparatus of claim 16, wherein the means for identifying the estimated platen temperature comprises means for identifying the estimated platen temperature based on at least one measurement of a temperature in the thermal printer.

18. The apparatus of claim 17, wherein the means for identifying the estimated temperature comprises means for identifying the estimated temperature based on a previous temperature of the platen, a temperature within the thermal printer, and an internal ambient temperature of the thermal printer.

19. The apparatus of claim 18, wherein the means for identifying the estimated temperature comprises means for identifying the estimate of the temperature based on a weighted sum of:

the previous platen temperature;

a difference between the temperature within the thermal printer and the previous platen temperature; and a difference between the internal ambient temperature and the previous platen temperature.

20. The apparatus of claim 18, wherein the internal ambient temperature comprises a measured internal ambient temperature.

21. The apparatus of claim 18, wherein the internal ambient temperature comprises a modeled internal ambient temperature.

22. The apparatus of claim 21, wherein the modeled internal ambient temperature is modeled based on the temperature within the thermal printer and an external ambient temperature of the environment of the thermal printer.

23. A method comprising:

(A) using a thermal history control algorithm to identify a plurality of input energies to send to a thermal printer to print a constant-density image on an output medium;

(B) providing the plurality of input energies to the thermal printer to print a printed image;

(C) measuring densities in the printed image;

(D) identifying a temperature of a platen in the thermal printer; and (E) identifying a platen correction parameter based on the measured densities and the identified platen temperature, wherein (E) comprises:

(E)(1) identifying a derivative of the measured densities with respect to the identified platen temperature; and (E)(2) identifying the platen correction parameter based on the derivative.

24. The method of claim 23, wherein (A) comprises:

(A)(1) estimating parameters of the thermal history control algorithm based on data acquired from the thermal printer during an acquisition period in which a temperature of the platen in the thermal printer has a substantially constant temperature; and (A)(2) using the thermal history control algorithm with the estimated parameters and a plurality of values of the platen correction parameter to identify the plurality of input energies; and wherein (E) comprises:

(E)(1) selecting, from among the plurality of values of the platen correction parameter, a value of the platen correction parameter corresponding to the printed image which deviates the least from constant density.

25. The method of claim 23, wherein (D) comprises identifying a measured temperature of the platen.

26. The method of claim 23, wherein (D) comprises identifying a modeled temperature of the platen.

27. The method of claim 23, wherein (A) comprises:

(A)(1) identifying values of parameters of the thermal history control algorithm that cause the thermal history control algorithm to identify a plurality of constant input energies;

(A)(2) using the thermal history control algorithm with the identified thermal history control parameter values to identify the plurality of input energies;

wherein (B) comprises:

(B)(1) identifying at least one temperature of the thermal printer while the printed image is printed; and wherein (E) comprises:

(E)(1) identifying the platen correction factor based on the at least one temperature of the thermal printer, the measured densities, and the input energy.

28. An apparatus comprising:

thermal history control means for using a thermal history control algorithm to identify a plurality of input energies to send to a thermal printer to print a constant-density image on an output medium;

input energy provision means for providing the plurality of input energies to the thermal printer to print a printed image;

density measurement means for measuring densities in the printed image;

platen temperature identification means for identifying a temperature of a platen in the thermal printer; and platen correction parameter identification means for identifying a platen correction parameter based on the measured densities and the identified platen temperature, wherein the platen correction parameter identification means comprises:

means for identifying a derivative of the measured densities with respect to the identified platen temperature; and means for identifying the platen correction parameter based on the derivative.

29. The apparatus of claim 28, wherein the thermal history control means comprises:

means for estimating parameters of the thermal history control algorithm based on data acquired from the thermal printer during an acquisition period in which a temperature of the platen in the thermal printer has a substantially constant temperature; and means for using the thermal history control algorithm with the estimated parameters and a plurality of values of the platen correction parameter to identify the plurality of input energies; and wherein the platen correction parameter identification means comprises:

means for selecting, from among the plurality of values of the platen correction parameter, a value of the platen correction parameter corresponding to the printed image which deviates the least from constant density.

30. The apparatus of claim 28, wherein the platen temperature identification means comprises means for identifying a measured temperature of the platen.

31. The apparatus of claim 28, wherein the platen temperature identification means comprises identifying a modeled temperature of the platen.

32. The apparatus of claim 28, wherein the thermal history control means comprises:

means for identifying values of parameters of the thermal history control algorithm that cause the thermal history control algorithm to identify a plurality of constant input energies;

means for using the thermal history control algorithm with the identified thermal history control parameter values to identify the plurality of input energies;

wherein the input energy provision means comprises:

means for identifying at least one temperature of the thermal printer while the printed image is printed; and wherein the platen correction parameter identification means comprises:

means for identifying the platen correction factor based on the at least one temperature of the thermal printer, the measured densities, and the input energy.

33. A method comprising:

(A) storing a first measured temperature of a thermal printer before the thermal printer is shut down;

(B) storing a first modeled temperature of the thermal printer before the thermal printer is shut down;

(C) identifying a second measured temperature of the thermal printer after the thermal printer starts up; and (D) initializing a second modeled temperature of the thermal printer based on the first measured temperature, the first modeled temperature, and the second measured temperature.

34. An apparatus comprising:

measured temperature storage means for storing a first measured temperature of a thermal printer before the thermal printer is shut down;

modeled temperature storage means for storing a first modeled temperature of the thermal printer before the thermal printer is shut down;

measured temperature identification means for identifying a second measured temperature of the thermal printer after the thermal printer starts up; and modeled temperature initialization means for initializing a second modeled temperature of the thermal printer based on the first measured temperature, the first modeled temperature, and the second measured temperature.

* * * * *